US005610627A

United States Patent [19]

Inamori et al.

[11] Patent Number: 5,610,627

[45] Date of Patent: Mar. 11, 1997

[54] CLOCKING METHOD AND APPARATUS FOR DISPLAY DEVICE WITH CALCULATION OPERATION

[75] Inventors: Yoshimitsu Inamori, Nara; Koichi Oda, Sakai, both of Japan

[73] Assignee: Sharp Kabushiki Kaisha, Osaka, Japan

[21] Appl. No.: 194,319

[22] Filed: Feb. 10, 1994

Related U.S. Application Data

[62] Division of Ser. No. 742,898, Aug. 8, 1991, abandoned.

[30] Foreign Application Priority Data

| | | | |
|---|---|---|---|
| Aug. 10, 1990 | [JP] | Japan | 2-213161 |
| Aug. 10, 1990 | [JP] | Japan | 2-213164 |
| Aug. 10, 1990 | [JP] | Japan | 2-213166 |
| Aug. 10, 1990 | [JP] | Japan | 2-213168 |
| Aug. 10, 1990 | [JP] | Japan | 2-213170 |

[51] Int. Cl.[6] ..... G09G 3/36

[52] U.S. Cl. ..... 345/99; 345/87; 345/91

[58] Field of Search ..... 345/99, 87, 94, 345/95, 96, 97, 98, 208, 209, 210; 348/790, 792, 793; 359/54, 55, 56

[56] References Cited

U.S. PATENT DOCUMENTS

| | | | |
|---|---|---|---|
| 4,218,876 | 8/1980 | Hashimoto et al. | 368/364 |
| 4,850,676 | 7/1989 | Yazaki et al. | 345/97 |
| 4,909,607 | 3/1990 | Ross | 345/94 |
| 4,926,168 | 5/1990 | Yamamoto et al. | 345/96 |
| 5,049,865 | 9/1991 | Nakamura et al. | 359/55 |

FOREIGN PATENT DOCUMENTS

| | | |
|---|---|---|
| 56-164393 | 12/1981 | Japan . |
| 63-125918 | 5/1988 | Japan . |
| 63-118720 | 5/1988 | Japan . |
| 2107494 | 4/1983 | United Kingdom . |
| 2143656 | 2/1985 | United Kingdom . |

*Primary Examiner*—Kee M. Tung
*Assistant Examiner*—Doon Chow
*Attorney, Agent, or Firm*—Nixon & Vanderhye, P.C.

[57] ABSTRACT

A clock generation circuit (23) is provided for use with a data display device and a calculation unit, with the calculation unit performing a calculation in a calculation mode resulting in data which is displayed on the data display device. The clock generation circuit generates a first clock signal (CK2) and a second clock signal (CK1). The second clock signal (CK1) is generated by a circuit (52) only during a calculation mode. A clock switching circuit (54) selects, in dependence upon whether the calculation mode is being executed, between a clock signal (CKD) derived from the signal (CK1) and an independently-produced clock signal (CKI) for use as the first clock signal (CK2). Thus, power is conserved by turning off the circuit (52) during a pure display mode and by turning off an oscillator (24) which generates the signal (CKI) during a calculation mode.

10 Claims, 20 Drawing Sheets

(1)

(2)

CLOCKING METHOD AND APPARATUS FOR DISPLAY DEVICE WITH CALCULATION OPERATION

This is divisional of application Ser. No. 07/742,898, filed Aug. 8, 1991, now abandoned.

BACKGROUND OF THE INVENTION

1. Field of the Invention

The present invention relates to a driving-device for a display device which, for example, can be preferably incorporated in a liquid crystal display device or the like device.

2. Description of Related Art

FIG. 1 is a block diagram showing a basic construction of a conventional liquid crystal display device 101. A display panel 102 comprises a pair of transparent substrates, the substrates being spaced from each other with a liquid crystal layer therebetween. A plurality of common electrodes and segment electrodes are provided on a surface of each transparent substrate facing the liquid crystal layer. The display panel 102 is divided into a plurality of display regions (for example 2) 103*a*, 103*b*. The segment electrodes constituting the display region 103*a* are driven by a first segment electrode driving circuit 105*a*. The segment electrodes constituting the display region 103*b* are driven by a second segment electrode driving circuit 105*b*. The common electrodes are driven by a common electrode driving circuit 104.

The common electrode driving circuit 104, the first segment electrode driving circuit 105*a* and the second segment electrode driving circuits 105*b* are driven in accordance with display control data sent from a central processing unit (hereinafter referred to as CPU) 106. The common electrode driving circuit 104 comprises a display controller 107, calculation section 108, and a clock generating circuit 109.

The CPU 106 feeds the display control data to the common electrode driving circuit 104. The calculation section 108 of the common electrode driving circuit 104 is adapted to calculate information indicative of the designated display region where display data is to be displayed and display address information in the designated display region in accordance with the display control data fed from the CPU 106.

The display controller 107 selects either of the first segment electrode driving circuit 105*a* or the second segment electrode driving circuit 105*b* in accordance with the display region designating information, and feeds the display address information to the selected segment electrode driving circuit. The display controller 107 selects the common electrode in accordance with the display address information, and applies a voltage to the selected common electrode. Further, the selected segment electrode driving circuit selects the segment electrode in accordance with the display address information, and applies a voltage to the selected segment electrode. In such a manner as described above, display operation is executed on the display panel 102.

The display controller 107 and the calculation section 108 execute their respective operations, in synchronization with a clock signal sent from the clock generating circuit 109. The clock signal generating circuit 109 comprises a CR oscillator. A resistor 110 is externally attached to the clock signal generating circuit 109, which sends a clock signal having, for example, a frequency of about 32 kHz.

In the common electrode driving circuit 104 of the liquid crystal display device 101, the clock signal generating circuit 109 sends a relatively low speed clock signal to the calculation section 108 as well as the display controller 107 so as to execute the calculation operation. This presents a problem that the calculation operation is executed at a low speed. Particularly, in order to effect a function accompanied by a complex processing, such as a window function and an address converting function, the clock signal for controlling the display is too slow for the calculation section 108 to execute the calculation operation. Accordingly, there are some cases where the calculation section 108 cannot be suited for actual use.

The window function is a function for displaying a different display data in a specific display region set in the display region on a display screen where an display data is already displayed.

Further, in the case where the frequency of the clock signal is amplified so as to execute the calculation operation at a high speed, the liquid crystal display device consumes more power. Particularly, for example, in a portable electronic device called generally as an electronic notebook, the power is supplied by cells. Accordingly, the life of the cells is shortened, which presents a problem.

A liquid crystal display device of a simple matrix type comprises a plurality of electrodes formed in both a row direction and a column direction interlaced with each other on a pair of transparent substrates. Each row direction electrode is scanned by a column direction driving circuit along the column direction. Each column direction electrode is scanned by a row direction driving circuit along the row direction. A display signal is sent each time the scanning is completed for each row direction electrode. The row direction driving circuit and the column direction driving circuit execute the respective foregoing operations in accordance with the display signal and a scan signal from a central processing unit (CPU).

Liquid crystal is filled between the row direction electrodes and the column direction electrodes. In order to prevent an occurrence in which a direct current is applied to the liquid crystal, the display signal is added onto an inversion signal whose polarity periodically inverts and alternated in the CPU, and applied to the liquid crystal with the polarity thereof inverting periodically.

An example of the inversion signal FRM is shown in FIG. 2(2). FIG. 2(1) shows a timing sequence diagram of a clock signal generated in the CPU. The inversion signal FRM is generated by counting the number of clocks corresponding to a duty (e.g., 1/146 DUTY) of the operation of the row direction driving circuit and causing the polarity thereof to invert by a toggling operation. More specifically, a clock signal LCK shown in FIG. 2(1) is counted by a counter or the like provided in the CPU. Upon the first fall of the clock signal LCK, the inversion signal LCK switches from a low level to a high level.

Thereafter, 146 clock signals LCK are counted, and the inversion signal FRM switches from the high level to the low level upon the 146th fall of the clock signal LCK. The inversion signal is generated by executing the toggling operation in a similar manner.

In the conventional liquid crystal display device utilizing the inversion signal FRM described above, in the case where a character "F" is to be displayed as illustrated in FIG. 3, it is known that an error display 112 represented by a broken line in FIG. 3 occurs below a lighted display region 111 on a lower portion of the column direction electrode having many lighted addresses in the column direction of the liquid crystal display device 101, i.e., in a Y-direction in FIG. 3.

Such an error display 112 causes the quality of the display of the liquid crystal display device 101 to deteriorate greatly.

FIG. 4 is a diagram showing an electrical construction of a conventional liquid crystal display device 201 of a typical type. The liquid crystal display device 201 comprises a matrix driven liquid crystal element 202, a column direction driving circuit 203 for scanning the liquid crystal element 201 in the column direction, and a row direction driving circuit 204 for scanning the liquid crystal element 201 in the row direction and outputting the display data. The display data outputted from a display data output unit 205 provided in the row direction driving circuit 204 has its voltage level converted by a level shifter 206, for example, from a transistor level to a drive level of the liquid crystal element 202. The outputs from the level shifter 206, both inverted and non-inverted, are respectively connected to pairs of NAND circuits 207, 208, and NOR circuits 209, 210.

To the row direction driving circuit 204 is sent from outside the inversion signal FRM for alternating the display voltage. An inversion signal FRM' (obtained by amplifying the inversion signal FRM by a level shifter 211) is sent to the NAND circuits 207, 208, and the NOR circuits 209, 210 individually, respectively. In the row direction driving circuit 204, four mutually different kinds of driving voltagles V1 to V4 are generated to be applied to the liquid Crystal element 202. The respective potentials V1 to V4 are individually coupled to switching circuits 212, 213 comprising respectively transistors having a P-channel metal oxide semiconductor (MOS) structure, switching circuits 214, 215 comprising respectively transistors having a N-channel MOS structure. Outputs from the respective switching circuits 212 to 215 are inputted to the liquid crystal display element 202 through a common line 216.

In the row direction driving circuit 204 thus constructed, the switching circuits 212 to 215 receive outputs respectively from the NAND circuits 207, 208, and NOR circuits 209, 210. The outputs of the NAND circuits 207, 208, and NOB circuits 209, 210 depend on the four combinations based on whether the waveform of the data from the level shifter 206 is high level or low level, or whether the inversion signal FRM' is high level or low level. The logic circuits and the switching circuits are so controlled that when any one pair of logic circuit and switching circuit are communicating, the other remaining pairs are kept out of communication.

In the crystal display device of this prior art, when the polarity of the inversion signal FRM is converted from a high level to a low level or vice-versa, an overlapping period occurs during which the respective switching circuits 212 to 215 are simultaneously turned on based on the difference in response to the level conversion of the signal FRM between the P-channel switching circuits 212, 213 and the N-channel switching circuits 214, 215, i.e., on the characteristics that the P-channel switching circuits 212, 213 respond less quickly than the N-channel switching circuits 214, 215. Thereby, the respective driving voltages V1 to V4 are simultaneously connected to the common line 216, whereby the current flows through the common line 216. Accordingly, power consumption of the row direction driving circuit 204 is increased. Further, it stands as a problem that the row direction driving circuit 204 is liable to meet a damage due to the current flowing through the common line 216.

The display voltage based on the display data is applied to the liquid crystal layer filled between the row direction electrodes and the row direction electrodes so as to execute the display operation. In order to improve such display characteristics in the liquid crystal display device, the method is adopted by which plural kinds of driving voltages are generated in the liquid crystal display device, the desired driving voltage is selected out of the plural ones, and the level of the display signal is adjusted to the selected driving voltage.

FIG. 5 is a circuit diagram of a display power circuit 121 of a typical prior art device. The display power circuit 121 comprises a variable resistor VR having one end thereof connected to a display power voltage VE, and resistors, for example 5, R1, R2, R3, R4, and R5 connected to the other end of the variable resistor VR. The resistors R1 to R5 are connected in series to one another. Respective outputs from nodes P1, P2, P3, P4, and P5 between the variable resistor VR and the respective resistors R1, R2, R3, R4, and R5 are inputted to amplifiers A1, A2, A3, A4, and A5, and the driving currents are amplified therein. Consequently, a plurality of mutually different display voltages V1, V5, V3, V4, and V6 are respectively outputted from the amplifiers A1, A2, A3, A4, and A5. An output from a node P6 between the variable resistor VR and a grounded side of the resistor R5 is used as a display voltage V2.

The resistors R1, R2, R3, R4, and R5 for dividing the voltage are referred to as bleeder resistors, and respectively takes resistance values r1, r1, r2, r1, and r1. With the use of resistance values r1, r2, and the resistors R1, R2, R3, R4, and R5, an optimum bias voltage value Vbi can be expressed based on the driving duty DUTY of the liquid crystal display device in the following first equation.

$$\begin{aligned} Vbi &= (R1 \times 4 + R2)/R1 \\ &= (\sqrt{DUTY}) + 1 \end{aligned} \tag{1}$$

More specifically, in the case where the driving duty of the liquid crystal display device of this prior art is, for example, 1/146 DUTY, the optimum bias voltage value Vbi is obtained from the first equation (1):

$$\begin{aligned} Vbi &= (R1 \times 4 + R2)/R1 \\ &= (\sqrt{146}) + 1 \\ &\approx 13 \end{aligned} \tag{2}$$

Accordingly, the following third expression is obtained:

$$R2 = 9 \times R1 \tag{3}$$

Therefore, the ratio of the voltage divided by the respective resistors R1 to R5 is 1:1:9:1:1. The display voltage level is thus determined.

FIG. 6 is a diagram showing an operation of the liquid crystal display device of this prior art device. In the case where contrast adjustment is not to be effected in the display power circuit 121, the resistance value r of the variable resistor VR is set at "0". The display voltage V1, which is the maximum in the display voltages V1 to V6, corresponds with the display power voltage VE. FIG. 6(A) shows a case where the contrast adjustment is effected with the use of the display power circuit 121, and the resistance value r of the variable resistor VR is set at a non-zero arbitrary value. In this case, the maximum display voltage V1 is reduced from the display power voltage VE by a potential difference ΔV. The level of the remaining voltages V2 to V6 are also reduced with the ratio of potentials therebetween maintained at V1–V5:V5–V3:V3–V4:V4–V6:V6–V2=1:1:9:1:1 as shown in FIG. 6(A).

On the other hand, in the case where the contrast adjustment is not to be effected in the display power circuit 121, the maximum display voltage V1 is supposed to correspond with the display power voltage VE. However, it is generally known that the maximum value of the display voltage V1 is lower than the display power voltage VE by a potential difference δV of about 2 to 3 V due to the characteristics of the amplifier A1. The maximum display voltage V1 in this state is shown with a broken like in FIG. 6(B). In the case where the maximum display voltage V1 is reduced to an undesirable level, the potentials of the display voltages V1 to V6 cannot be maintained at the foregoing ratio. Accordingly, the quality of the display will be undesirably deteriorated.

In view of this, the liquid crystal display device of this prior art presents a problem that the quality of the display will be deteriorated in the case where the contrast adjustment is not effected.

FIG. 7 is a partially circuit diagram and partially block diagram showing a basic construction of another conventional liquid crystal display device 301. A display unit 302 comprises a pair of transparent substrates provided with a liquid crystal layer therebetween. A plurality of the common electrodes and segment electrodes are disposed on surfaces of the respective transparent substrates facing the liquid crystal layer. The common electrodes and the segment electrodes are respectively driven by a common electrode driving circuit 303 and a segment electrode driving circuit 304.

A central processing unit (hereinafter referred to as a CPU) 305 is adapted for centrally controlling the liquid crystal display device 301. The CPU 305 sends display data to the common electrode driving circuit 303, and then to the segment electrode driving circuit 304. Based on the display data sent from the CPU 305, the common electrode driving circuit 303 and the segment electrode driving circuit 304 respectively select the common electrodes and the segment electrodes, and apply the voltages to the selected electrodes.

A power circuit 306 feeds liquid crystal driving voltages V1, V2, V5, and V6 to the common electrode driving circuit 303. The power circuit 306 also feeds liquid crystal driving voltages V1, V2, V3 and V4 to the segment electrode driving circuit 304. In the power circuit 306, a voltage reel supplied from a power source 307 is adjusted by a variable resistor 309 to a voltage Vee2, which is fed to an applied voltage generating circuit 310. Between the power supply 307 and the variable resistor 309 is provided a switch 308, which is turned off upon receiving an OFF signal S11 from the CPU 305. This causes the power supply from the power source 307 to the applied voltage generating circuit 310 to be interrupted.

The applied voltage generating circuit 310 includes five resistors R11*a*, R11*b*, R11*c*, R11*d*, and R12 so as to divide the voltage Vee2 and generate driving voltages V1 to V6. These five resistors R11*a*, R11*b*, R11*c*, R11*d*, and R12 are generally referred to as bleeder resistors. The resistors R11*a*, R11*b*, R12, R11*c*, and R11*d* are connected in series in this order to the variable resistor 309. One end of the resistor R11*d* is grounded. Resistance values r11a to r11d of the respective resistors R11*a* to R11*d* are all set at a same value. A resistance value r12 of the resistor R12 varies according to the driving duty DUTY of the display unit 302 and the optimum bias value b, and can be obtained using the following fourth equation.

$$b = (r11a \times 4 + r12)/r11a \quad (4)$$
$$= (\sqrt{DUTY}) + 1$$

Further, smoothing capacitors C11 to C16 for stabilizing the applied voltages are connected respectively between nodes E1 to E6 and the common electrode driving circuit 303 or the segment electrode driving circuit 304.

Out of the voltages V1 to V6 supplied from the power circuit 306, the voltages V1, V2, V5, and V6 are supplied to the common electrode driving circuit 303, and the voltages V1, V2, V3, V4 are supplied to the segment electrode driving circuit 304.

In the liquid crystal display device 301 described above, the smoothing capacitors C11 to C16 are provided so as to stabilize the voltage level applied to the display unit 302. Even in the case where the switch 308 is turned off to interrupt the power supply from Dower source 307 to the applied voltage generating circuit 310, which in turn causes the display unit 302 to stop displaying, electric charges stored in the capacitors C11 to C16 are gradually discharged in accordance with the discharge characteristics. Accordingly, the voltage is applied to the liquid crystal layer in the display unit 302, whereby, so-called, a residual image is displayed on the display unit 302.

SUMMARY OF THE INVENTION

It is an object of the present invention to solve the foregoing technical problems and provide a driving device for a display device capable of executing a calculation operation at a high speed.

It is another object of the invention to solve the foregoing technical problems and provide a driving device for a display device which has an remarkably improved display quality.

It is still another object of the invention to solve the foregoing technical problems and provide a driving device for a display device which prevents an occurrence of a through current therein so as-to reduce power consumption thereof.

Accordingly, a driving device of the invention for a display device having a plurality of picture elements and executable a display operation in accordance with display data fed to each picture element, the driving device comprising:

means for feeding the display data to the plurality of picture elements in synchronization with a clock signal inputted thereto;

calculating means for executing a calculation operation based on the display data and feeding the calculation result to the display data feeding means in synchronization with a clock signal inputted thereto;

means for generating a first clock signal having a predetermined frequency; and means for generating a second clock signal having a frequency higher than the predetermined frequency;

whereby the first clock signal is fed to the display data feeding means when only the display operation is to be executed, and the first clock signal is fed to the display data feeding means and the second clock signal is fed to the calculating means when the display operation and the calculation operation are to be executed.

According to the invention, only the first clock signal is fed to the display data feeding means when only the display operation is to be executed. The display data feeding means feeds the display data to the plurality of picture elements in synchronization with the first clock signal so as to execute the display operation. Further, in the case where the display operation and the calculation operation are to be executed simultaneously, the first clock signal is fed to the display data feeding means and the second clock signal is fed to the calculating means. Accordingly, the display data feeding means executes the display operation in accordance with the first clock signal similar to the foregoing case where only the display operation is to be executed. The calculating means executes the calculation operation based on the display data in synchronization with the second clock signal having a frequency higher than that of the first clock signal, and feeds the calculation result to the display data feeding means. The display data feeding means executes the display operation based on the calculation result. At this time, it may be appropriate that the second clock signal have the frequency thereof divided so as to generate a signal having a frequency almost same as the first clock signal, and the resultant signal be fed to the display data feeding means.

Having a feature as described above, the calculation operation can be executed at a high speed when a function requiring a complex calculation operation such as a window function and an address converting function is effected. Further, the second clock signal is fed to the calculating means only when the calculation operation is to be executed. Therefore, a power consumption in the driving device for the display device can be reduced. The present invention is particularly effective for use in an electronic device provided with a display device and dependent its power supply on cells.

As described above, according to the invention, the calculation operation can be executed at a high speed when a function requiring a complex calculation operation such as a window function and an address converting function is effected. Further, since the second clock signal is fed to the calculating means only when the calculation operation is to be executed, the power consumption in the driving device for the display device can be reduced. The invention is particularly effective for use in an electronic device provided with a display device and dependent its power supply on the cells, Further, a driving device of the invention for a display device comprising:

row direction driving means, connected to the display device having a pair of transparent substrates on which a plurality of row direction electrodes and column direction electrodes are formed so as to display a display data, for scanning the column direction electrodes along a row direction and outputting a display signal;

column direction driving means, connected to the display device and the row direction driving means, for scanning the row direction electrodes along a column direction and outputting a display signal and a scan signal of the column electrodes to the row direction driving means; and controlling means, connected to the column direction driving means, for outputting a display signal, a scan signal, and a first inversion signal so as to periodically switch the polarity of the display signal to be applied to the display device;

the column direction driving means including means for generating a second inversion signal having a frequency higher than that of the first inversion signal inputted thereto, and means for selecting either the first inversion signal or the second inversion signal.

According to the invention, in the case where the image is to be displayed in the display device, the row direction driving means scans the column direction electrodes along the row direction. The column direction driving means scans the row direction electrodes along the column direction, and outputs a display signal and a scan signal of the column electrodes to the row direction driving means. To the column direction driving means is connected the controlling means so as to output the display signal, the scan signal and the first inversion signal. The first inversion signal is used for periodically switching the polarity of the display signal applied to the display device so as to prevent a direct current from being applied to the display device.

In the column direction driving means, the signal generating means generates the second inversion signal having a frequency higher than that of the first inversion signal inputted thereto, the signal selecting means selects either the first inversion signal or the second inversion signal.

Accordingly, in the invention, the second inversion signal is selected in the case where there are many displaying addresses on the column direction electrode. Thereby, it can be prevented that an undesirable display is made in a non-display region on the column direction electrode having relatively many displaying addresses. This results in an improved quality of the display in the display device. Further, since either the first inversion signal or the second inversion signal is selected, in the case where there are relatively few displaying addresses on the column electrode, the first inversion signal is selected so as to reduce the power consumption of the driving device.

As described above, according to the invention, in the column direction driving means, the signal generating means generates the second inversion signal having a frequency higher than that of the first clock signal inputted to the column direction driving means, and the signal selecting means selects either of the first inversion signal or the second inversion signal. Accordingly, in the case where there are many displaying addresses on the column direction electrode, the second inversion signal is selected. Thereby, it can be prevented that an undesirable display is made in a non-display region on the column direction electrode having relatively many displaying addresses. This results in an improved quality of the display in the display device. Further, since either the first inversion signal or the second inversion signal is selected, in the case where there are relatively few displaying addresses on the column electrode, the first inversion signal is used so as to reduce the power consumption of the driving device.

Moreover, a driving device of the invention for a display device comprising:

column direction driving means, connected to the display device having a pair of transparent substrates on which a plurality of row direction electrodes and column direction electrodes are formed so as to display a display data, for scanning the row direction electrodes along a column direction; and row direction driving means, connected to the display device, for scanning the column direction electrodes along a row direction and outputting a display signal;

wherein the row direction driving means comprises:

potential selecting means available in a plural number connected to a plurality of mutually different potentials, outputs thereof being commonly connected to the respective column direction electrodes;

selection controlling means for selecting any one of the plurality of the potential selecting means and turning on the selected potential selecting means in accordance with the display signal and an inversion signal having a predetermined frequency inputted thereto;

means for forcibly regulating the respective potential selecting means so as to be turned off for a predetermined period of time each time the polarity of the inversion signal is switched.

According to the invention, in the case where the display operation is executed using the row direction driving means and the column direction driving means, both connected to the display device, the column direction driving means scans the row direction electrodes, and the row direction driving means scans the column direction electrodes and outputs a display signal. The row direction driving means is provided with the plurality of potential selecting means connected to the respective column direction electrodes. The potential selecting means are connected to the plurality of mutually different potentials. The selection controlling means controllably turns on any one of the plurality of potential selecting means in accordance with the display signal and the inversion signal inputted thereto at a predetermined frequency. At this time, in the case where there is a difference in response to the selection controlling means among the plural potential selecting means, such a case can be considered to occur where all the potential selecting means are turned on at a timing when the polarity of the inversion signal is switched. However, in the invention, the forced switching means is provided so that the respective potential selecting means are regulated to be turned off for a predetermined period of time each time the polarity of the inversion signal is switched.

Thereby, a through current can be prevented from flowing due to the fact that all the potential selecting means are turned on to connect the plurality of potentials to the row direction electrodes. As a result, it is prevented that the power consumption of the row direction driving means is increased due to the through current. Further, a problem can be prevented from occurring in an electric circuit due to the through current.

As described above, according to the invention, in the case where there is a difference in response to the selection controlling means among the plurality of the potential selecting means, such a case can be considered to occur where all the potential selecting means are turned on at a timing when the polarity of the inversion signal is switched. However, in the invention, the forced switching means is provided so that the respective potential selecting means are regulated to be turned off for a predetermined period of time each time the polarity of the inversion signal is switched. Thereby, a through current can be prevented from flowing due to the fact that all the potential selecting means are turned on to connect the plurality of potentials to the row direction electrodes. As a result, it is prevented that the power consumption of the row direction driving means is increased due to the through current. Further, a problem can also be prevented from occurring in an electric circuit due to the through current.

Furthermore, a driving device of the invention for determining a level of a display signal applied to a liquid crystal display device having a pair of transparent substrates and a liquid crystal layer provided between the substrates, the driving device comprising:

outputting means, one end of which is connected to a reference voltage, for outputting an adjustment signal so as to adjust the contrast of an image displayed in the liquid crystal display device;

a first amplifying means for amplifying a level of the adjustment signal from the adjustment signal output means;

bleeder means, to one end of which the amplified adjustment signal is inputted, comprising a plurality of resistor means connected in series to one another for dividing the voltage of the inputted signal; and a second amplifying means for amplifying a plurality of mutually different signal level potentials obtained by dividing the adjustment signal by the bleeder means.

According to the invention, the level of the display signal applied to the liquid crystal display device is changed so as to adjust contrast of the display in accordance with the adjustment signal from the adjustment signal outputting means. The level of the adjustment signal from the adjustment signal outputting means is amplified by the first amplifying means. The amplified adjustment signal is voltage divided by the bleeder means comprising the plurality of resistor means connected in series to one another. The plurality of mutually different signal level potentials from the bleeder means are respectively amplified by the second amplifying means.

In the case where the adjustment signal outputting means is not to effect the contrast adjustment, thereby the reference potential is outputted as it is, the output level may be reduced from the reference potential due to the saturated first amplifying means or other causes. Even in such a case, the adjustment signal has the level thereof amplified in advance by the first amplifying means to be fed to the bleeder means. Accordingly, by selecting a desired amplitude for the first amplifying means, the maximum signal level potential, out of the plurality of mutually different signal level potentials, will not be reduced to an undesirable level. Thereby it is prevented that the quality of the display will be deteriorated.

As described above, according to the invention, in the case where the adjustment signal outputting means is not to effect the contrast adjustment, and thereby the reference potential is outputted as it is, the level of the outputting of the first amplifying means may be reduced from the reference potential. Even in such a case, the adjustment signal has the level thereof ,amplified in advance by the first amplifying means to be fed to the bleeder means. Accordingly, by selecting a desired amplitude for the first amplifying means, the maximum signal level potential, out of the plurality of mutually different signal level potentials, will not be reduced to the undesirable level. As a result, it is prevented that the quality of the display will be deteriorated.

Also, a driving device of the invention for a display device comprising:

a liquid crystal display device having a predetermined display electrode;

power supply for supplying a display voltage to be applied to the display electrode;

a switch provided between the liquid crystal display device and the power supply and actuatable for supplying the display voltage to the liquid crystal display device or interrupting the supply of the display voltage thereto;

a capacitor one terminal of which is connected between the liquid crystal display device and the switch, and the other terminal of which is grounded; and means, provided between the one terminal of the capacitor and the liquid crystal display device, for forcibly adjusting a potential at the one terminal of the capacitor to a potential at the other terminal thereof.

According to the invention, the display voltage from the power supply is applied to the display electrodes included in the liquid crystal display device so as to execute the display operation. At this time, even in the case where the electric charges stored in the capacitor causes the display voltage level to become unstable, i.e., the display voltage level varies, it is possible for the capacitor to stabilize the voltage level applied to the display electrodes by accumulating or discharging the electric charges.

When the display operation is to be stopped, the switch provided between the liquid crystal display device and the power source is turned off so as to interrupt the supply of the display voltage to the liquid crystal display device. This causes the display image to be cleared. The potential at the one terminal of the capacitor is forcibly adjusted to the potential at the other terminal thereof. Accordingly, the electric charges stored in the capacitor can be forcibly discharged.

In view of this, after the supply of the display voltage to the liquid crystal display device is interrupted, the electric charges stored in the capacitor are gradually discharged. The discharged electric charges are applied to the display electrodes, thereby preventing the so-called residual image from being displayed.

As described above, according to the invention, the forcibly adjusting means is provided for forcibly adjusting the potential at the terminal of the capacitor to the potential at the other terminal thereof so as to discharge the electric charges stored in the capacitor. Accordingly, after the supply of the display voltage to the liquid crystal display device is interrupted, the electric charges stored in the capacitor can be forcibly discharged therefrom. This can prevent the residual image to be displayed in the liquid crystal display device. As a result, the quality of the display of the liquid crystal display can be improved.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
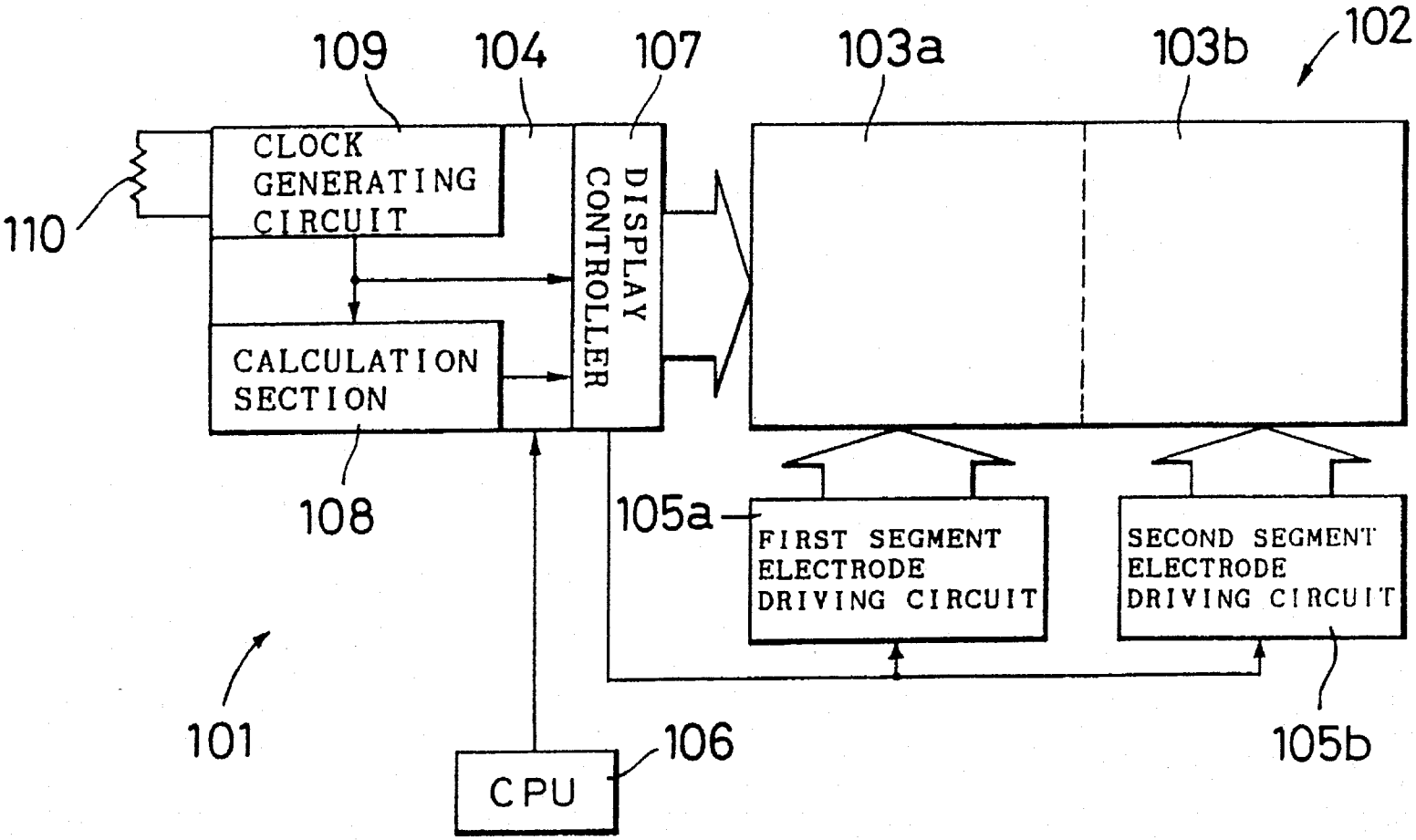
Fig. 1 Prior Art
FIG. 1 is a block diagram showing a basic construction of a conventional liquid crystal display device 101.
Figure 2:
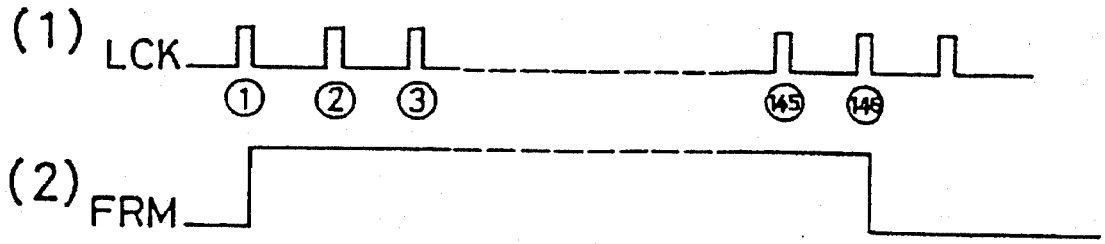
Fig. 2 Prior Art
FIG. 2, (1) and (2) are respectively timing sequence diagrams of signals used in the prior art.

Now referring to the drawings, preferred embodiments of the invention are described below.

Figure 8:
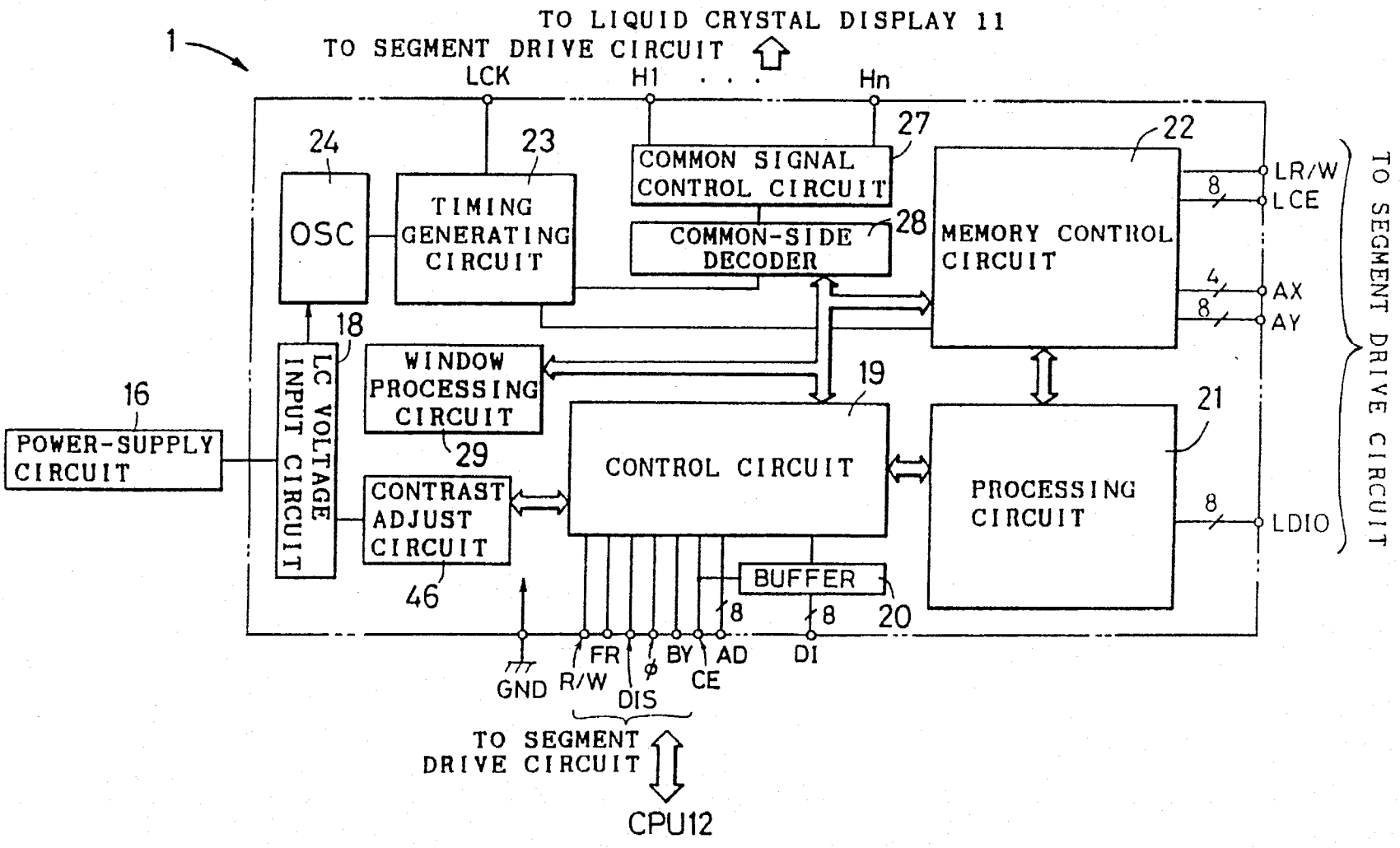
FIG. 8 is a block diagram showing a construction of a driving device embodying the invention.
Figure 9:
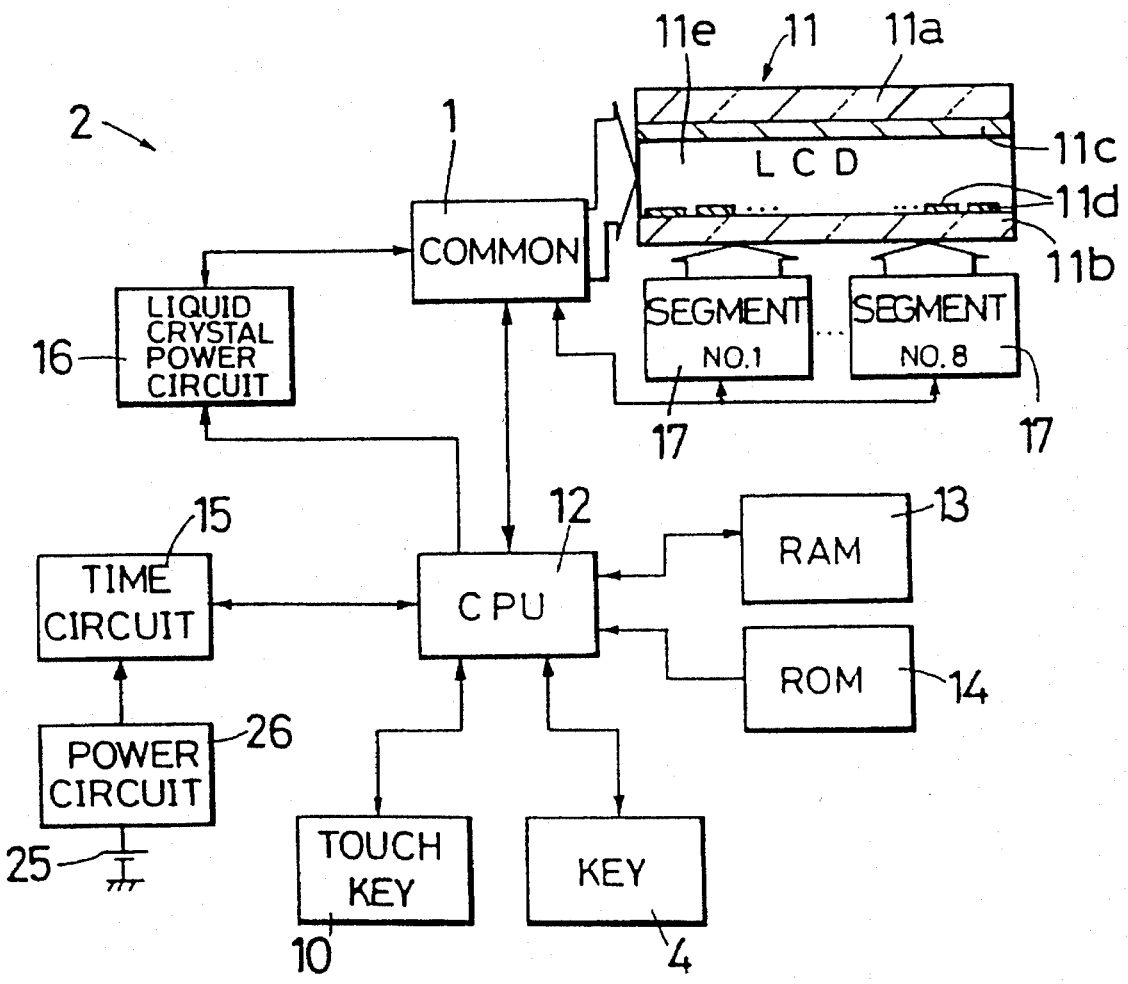
FIG. 9 is a block diagram showing a data processing device 2 provided with a common electrode driving circuit 1.
Figure 10:
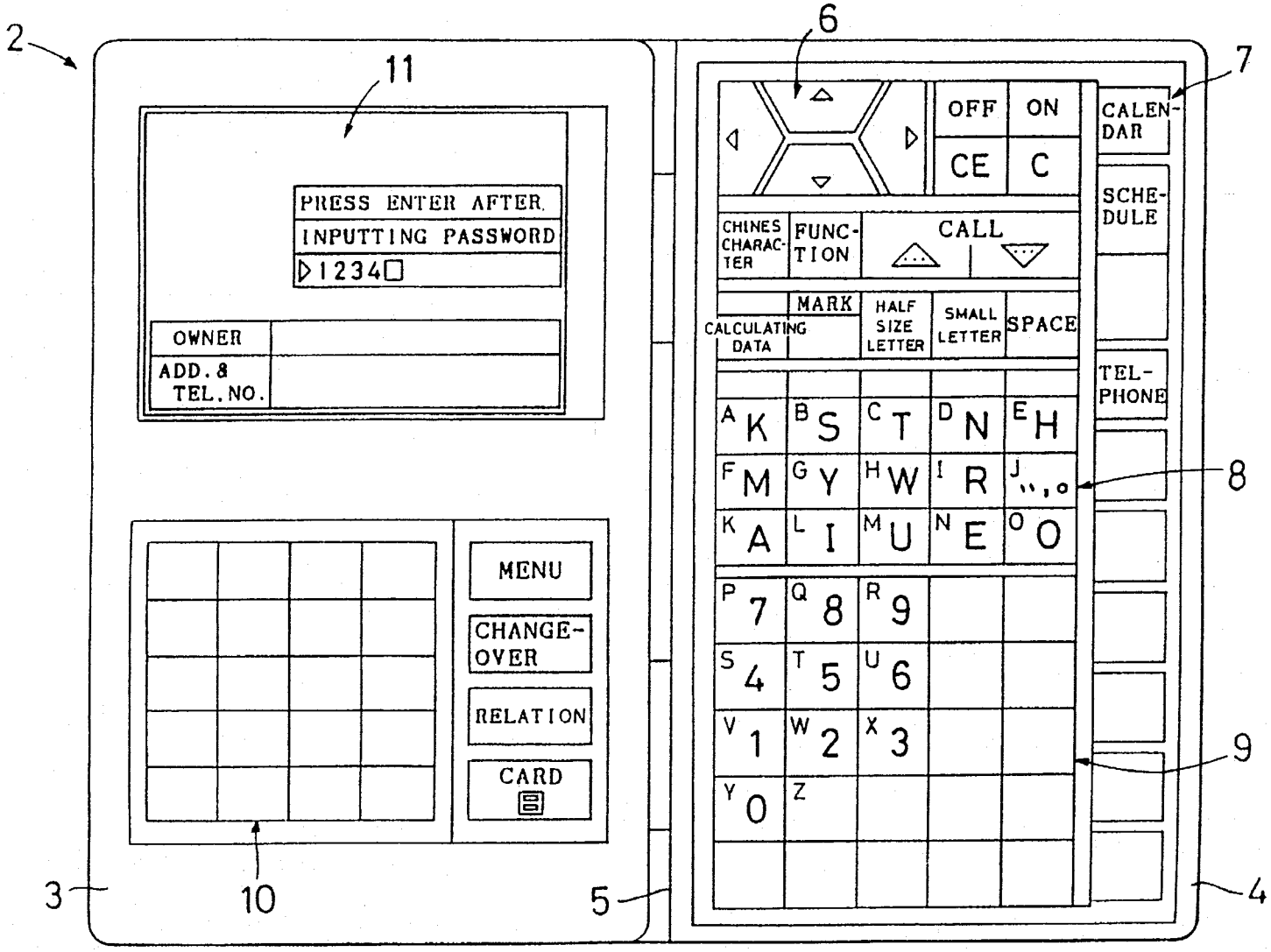
FIG. 10 a plan view of the data processing device 2.

FIG. 8 is a block diagram shoving a construction of a driving device incorporating the invention as an embodiment, FIG. 9 is a block diagram showing a data processing device 2 provided with a common driving circuit 1, and FIG. 10 is a plan view of the data processing device 2. The data processing device 2 is of a, so-called, notebook-size, and provided with a first operation unit 3 and a second operation unit 4. The first operation unit 3 and the second operation unit 4 are connected at a juncture 5 openably and closably. On the second operation unit 4 are arranged cursor keys 6, function keys 7, character input keys 8, and number input keys 9, etc. On the first operation unit 3 are arranged transparent touch keys 10 and a liquid crystal display device 11, etc.

The data processing device 2 having such a construction as described above comprises a central processing unit (hereinafter referred to as a CPU) 12 including, for example, a microprocessor. The touch keys 10 and the respective keys provided on the second operation unit 4 are connected to the CPU 12. Further, a random access memory (RAN) 13 and a read only memory (RAN) 14 are connected to the CPU 12. The RAM 13 provides a storage area for storing various input data and also serving as a working area for data in an operative state. The ROM 14 is adapted to store a program for regulating control operation of the CPU 12, font data for display and calendar data.

Further, to CPU 12 are connected a time circuit 15 for measuring the time, a common electrode driving circuit 1 for controlling display operation of the liquid crystal display device 11 in a manner to be described hereinafter, and a liquid crystal power circuit 16. The liquid crystal power circuit 16 varies a liquid crystal power potential supplied to the common electrode driving circuit 1 in accordance with a contrast signal from the common electrode driving circuit 1, and is turned on or off in response to a control signal from the CPU 12. A plurality of segment electrode driving circuits 17 (in this embodiment 8) are connected to the common electrode driving circuit 1, and control a display condition of the liquid crystal display device 11 together with the common electrode driving circuit 1. The liquid crystal display device 11 comprises a pair of transparent substrates 11*a*, 11*b*, a common electrode 11*c*, segment electrodes 11*d*, and a liquid crystal layer 11*e*. The common electrode 11*c* and the segment electrodes 11*d* are formed on the respective substrates 11*a*, 11*b* with the liquid crystal layer 11*e* therebetween.

FIG. 8 shows a block diagram of the common electrode driving circuit 1. The CPU 12 sends a read in/out control signal R/W, a clock signal $\phi$, and a chip enable signal CE to the common electrode driving circuit 1. The common electrode driving circuit 1 is provided with a control circuit 19, to which address data AD, display data DI and the like are inputted. The display data DI is inputted through a data buffer 20. The common electrode driving circuit 1 sends a frame signal FR, a control signal DIS for ON/OFF controlling the display by means of the segment electrodes, a clock signal LCK to the segment electrode driving circuits 17. Further the common electrode driving circuit 1 sends a busy signal BY to the CPU 12. As described above, the data processing device 2 is of a notebook size and therefore portable. Accordingly, various reference voltages necessary for the operation of the data processing device 2 are generated from a power circuit 26 connected to a cell 25.

To the control circuit 19 is connected a data processing circuit 21, in which predetermined logical operations (SET, AND, OR, XOR, etc.) are executed to the address data and the display data transferred from the CPU 12. Subsequently, the processed data are transferred to the segment electrode driving circuits 17. A memory control circuit 22 is adapted to determine to which segment electrode driving circuits 17 the address data from the CPU 12 is to be transferred, and generates a relative address in any of the selected segment electrode driving circuits 17. A timing generating circuit 23 is adapted to generate a clock signal or other signals used for various operations executed in the common electrode driving circuit 1. The timing generating circuit 23 receives a reference clock signal sent from an oscillator 24.

A common signal control circuit 27 and a decoder 27 provided therefor generate a common signal to be fed to the common electrodes of the liquid crystal display device 11 in accordance with the clock signal from the timing generating circuit 23. Further, to the control circuit 19 is connected a window processing circuit 29 having a construction and performing an operation to be described hereinafter. A contrast adjusting circuit 46 is adapted to store the density of the display in the liquid crystal display device 11. The CPU 12 sets density data in the contrast adjusting circuit 46. The contrast adjustment of the liquid crystal display device 11 is performed by the liquid crystal power circuit 16 shown in FIG. 9 in accordance with the density data in the contrast adjusting circuit 46. A liquid crystal voltage input unit 18 is provided for supplying the liquid crystal power potential from the liquid crystal power circuit 16 to the common electrode driving circuit 1.

Figure 11:
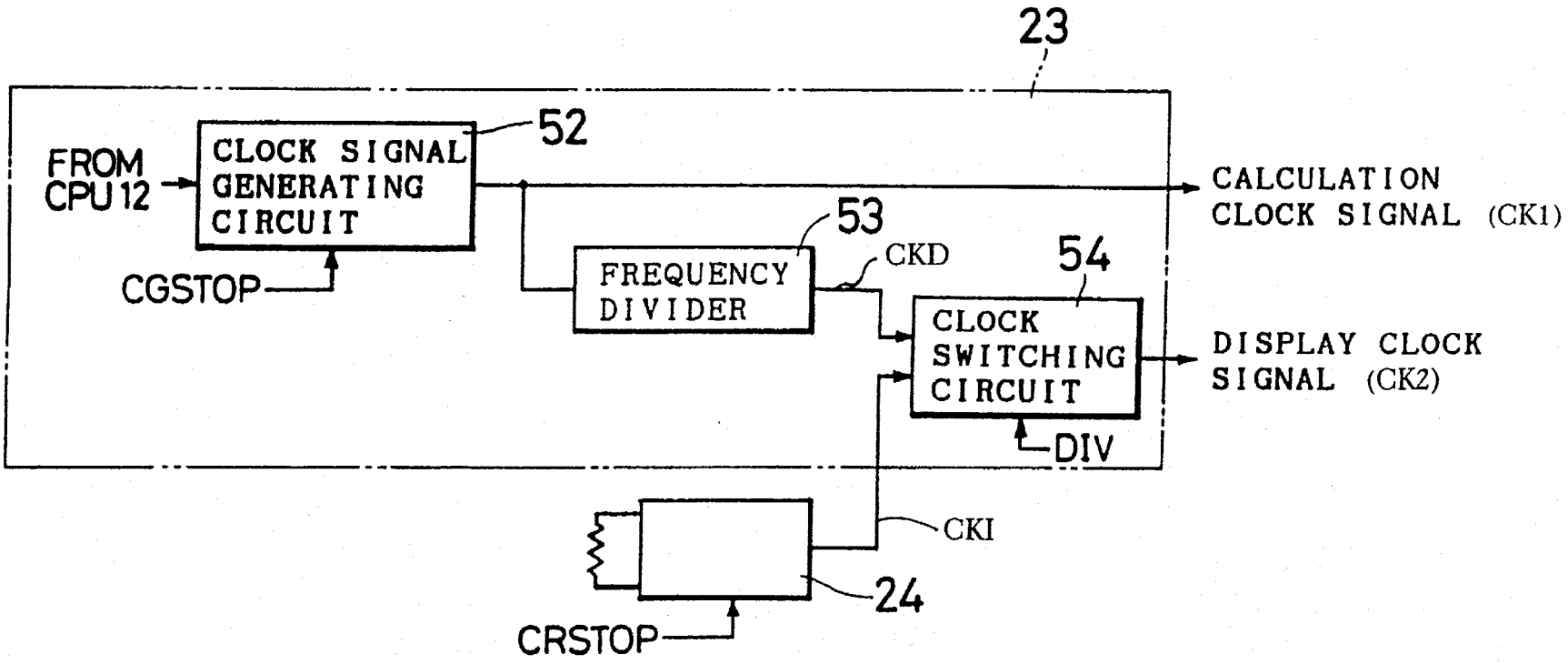
FIG. 11 is a block diagram showing a basic construction of a timing generating circuit 23.

FIG. 11 is a block diagram showing a basic construction of the timing generating circuit 23. The timing generating circuits 23 comprises a clock generating circuit 52, a frequency divider 53 and a clock switching circuit 54. The clock generating circuit 52 generates, for example, a clock signal CK1 for calculation operations having a frequency of 3 MHz in accordance with a signal CGSTOP for controlling a ON/OFF of the clock signal $\phi$ sent from the CPU 12. In this embodiment, the CPU 12 sends the clock signal $\phi$ having a frequency of 3 MHz to the clock generating circuit 52. The clock generating circuit 52 receives or stops receiving the clock signal $\phi$ from the CPU 12 in accordance with the control signal CGSTOP.

When the level of the control signal CGSTOP is low, the clock generating circuit 52 sends the clock signal CK1. On the other hand, when the level of the control signal CGSTOP is high, the clock generating circuit 52 stops sending the clock signal CK1. The control signal CGSTOP is controlled by a value set in a register provided in the control circuit 19 in the common electrode driving circuit 1. More specifically, when the set value is "1", the level of the control signal CGSTOP is high. On the contrary, when the set value is "0", the level of the control signal CGSTOP is low.

The clock signal CK1 is fed to the data processing circuit 21, memory control circuit 22, window processing circuit 29, or the like provided in the common electrode driving circuit 1.

The clock signal generating circuit 52 also feeds the clock signal CK1 to the frequency divider 53. The frequency divider 53 is adapted to divide the clock signal having a frequency of, for example, 3 MHz so as to output a clock signal CKD having a frequency of, for example, 32 kHz. The clock signal from the frequency divider 53 is fed to the clock switching circuit 54.

The clock switching circuit 54 receives the clock signals from the frequency divider 53 and a CR oscillator 24. The clock switching circuit 54 switchably outputs the received clock signal in accordance with a control signal DIV fed from the CPU 12. More specifically, when the control signal DIV is "1", i.e., when the level of the control signal is high, the clock switching circuit 54 outputs the clock signal fed from the frequency divider 53 as a display clock signal CK2. On the other hand, when the control signal DIV is "0", i.e., when the level of the control signal is low, the clock switching circuit 54 outputs the clock signal CK1 fed from the CR oscillator 24 as a display clock signal CK2.

The oscillating operation of the CR oscillator 24 is controlled in accordance with a control signal CRSTOP fed from the CPU 12. Specifically, when the control signal CRSTOP is "0", i.e., when the level of the control signal is low, the CR oscillator 24 executes the oscillating operation to output the clock signal having a frequency of 32 kHz. When the control signal CRSTOP is "1", i.e., when the level of the control signal is high, the CR oscillator 24 stops executing the oscillating operation. Accordingly, when the display operation is not required, the CR oscillator 24 is caused to stop executing its predetermined oscillating operation by switching the level of the control signal CRSTOP to the high level. Therefore, useless power consumption can be effectively prevented.

Similar to the control signal CGSTOP, the control signals DIV, CRSTOP are also controlled by the values set in the register provided in the control circuit 19.

In this embodiment, the CPU 12 feeds the clock signal $\phi$ having a frequency of 3 MHz to the clock signal generating circuit 52. However, it may be appropriate that a ceramic resonator be substituted for the clock generating circuit 52, whereby to voluntarily oscillate.

Figure 12:
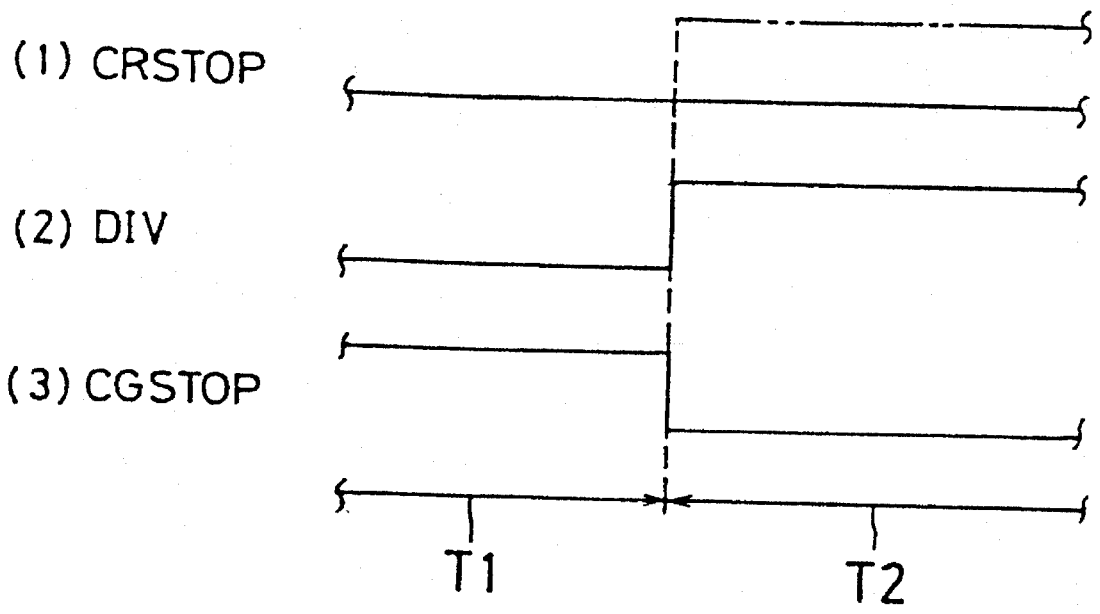
FIG. 12 is a timing chart showing an operation of the timing generating circuit 23.

FIG. 12 is a timing chart showing an operation of the timing generating circuit 23. The calculation Operation and the display operation are simultaneously executed during a time period T2. During the time period T2, the control signal CGSTOP is set at "0" (low level), and the control signal DIV is set at "1" (high level). Accordingly, the clock signal generating circuit 52 is caused to output the calculation clock signal CK1, and the clock switching circuit 54 is caused to output the clock signal from the frequency divider 53 as the display clock signal CK2. It will be desirable that the control signal CRSTOP is set at "1". Thereby, the CR oscillator 24 is caused to stop executing the oscillating operation, resulting in reduction in power consumption.

Only the display operation is executed during a time period T1. During the time period T1, the control signals CGSTOP, DIV, CRSTOP are respectively set at "1", "0", "0". Accordingly, the clock switching circuit 54 is caused to output the clock signal from the CR oscillator 24 as the display clock signal CK2, while the operation of the clock generating circuit 52 is stopped.

As will be seen above, the calculating clock CK1 is fed to various calculating circuits only when the calculation operation is to be executed. Accordingly, the power consumption can be reduced compared to the case where the high speed clock signal is constantly used. With this feature, it can be made possible that a portable electronic device, such as an electronic notebook, provided with a liquid crystal display device and dependent upon the cells or the like as power supply, has functions such as a window function and an address converting function which requires a complex calculation operation. Further, the complex calculation operation can be executed at a high speed when the various functions are to be effected.

Figure 13:
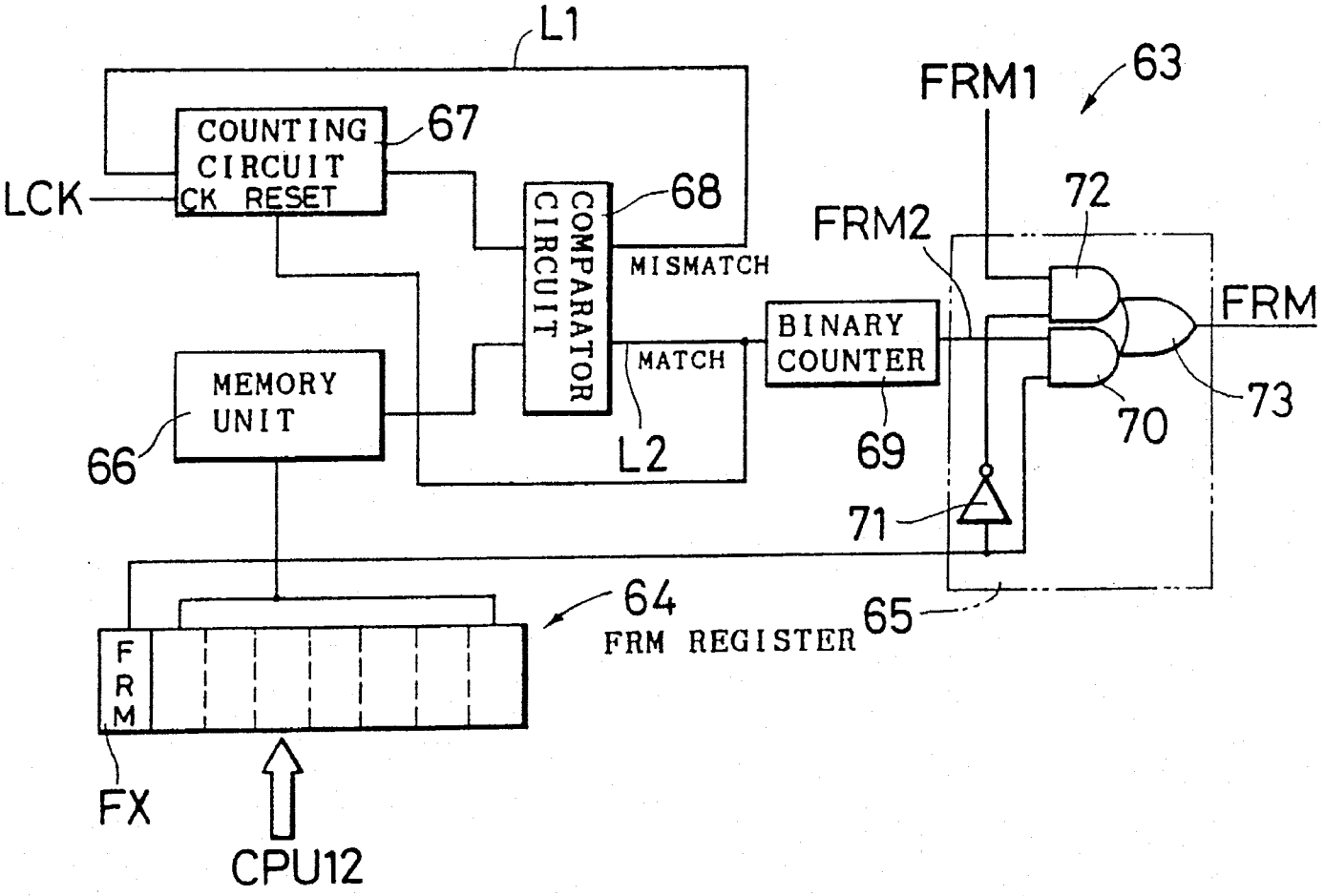
FIG. 13 is a block diagram showing a signal generating circuit 63 of a driving device embodying the invention.

FIG. 13 is a block diagram showing a signal generating circuit 63 included in the common electrode driving circuit 1 embodying the invention. The signal generating circuit 63 comprises a FRM register 64 of, for example. 8 bits. The processed FRM data is transferred from the CPU 12 to the FRM register 64 to be stored therein. Less significant 7 bits of the FRM register 64 determine a cycle of a second inversion signal FRM2 to be described hereinafter. A most significant bit FX regulates a selection operation of a signal selection circuit 65. The signal selection circuit 65 is adapted-to select either of the first inversion signal FRM1 inputted from the CPU 12 or the second inversion signal FRM2. The second inversion signal FRM 2 is generated in a manner to be described below and has a frequency higher than that of the first inversion signal FRM1. The FRM data constituted by the less significant 7 bits is transferred from the FRM register 64 to a memory unit 66 to be stored therein.

The clock signal generating circuit 63 is further provided with a counting circuit 67 and a comparator circuit 68. The counting circuit 67 is adapted to increment a count value by one each time the clock signal LCK is inputted thereto. The comparator circuit 68 is adapted to compare the count value in the counting circuit 67 and the FRM data. While detecting a mismatch between the count value and the FRM data, the comparator circuit 68 outputs a mismatch detection signal of a high level through a line L1 to the counting circuit 67, which in turn continues the incrementing operation.

Upon detecting a match between the input data, the comparator circuit 68 outputs a match signal which falls from a high level to a low level through a line L2 to the counting circuit 67. Upon receipt of the match signal, the comparator circuit 67 resets its counting operation. The match signal is also sent to a binary counter 69. Subsequently, an output value of the binary counter 69 is inputted to an AND circuit 70 constituting the signal selection circuit 65.

The most significant bit FX of the FRM register 64 is inputted to the AND circuit 70. The most significant bit FX is also inputted to an inverting circuit 71 in which an inversion signal is generated to be sent to an AND circuit 72. The inversion signal from the inverting circuit 71 and the first inversion signal FRM1 from the CPU 12 are inputted to the AND circuit 72 together. Outputs of the AND circuits 70, 72 are coupled to an OR circuit 73. An output of the OR circuit 73 serves as an output of the signal selection circuit 65, The signal selection circuit 65 outputs as an output inversion signal FRM either the second inversion signal FRM2 (also known as the programmable duration inversion signal) which is the output of the binary counter 69 or the first inversion signal FRM1 (also known as the nominal duration inversion signal).

Figure 14:
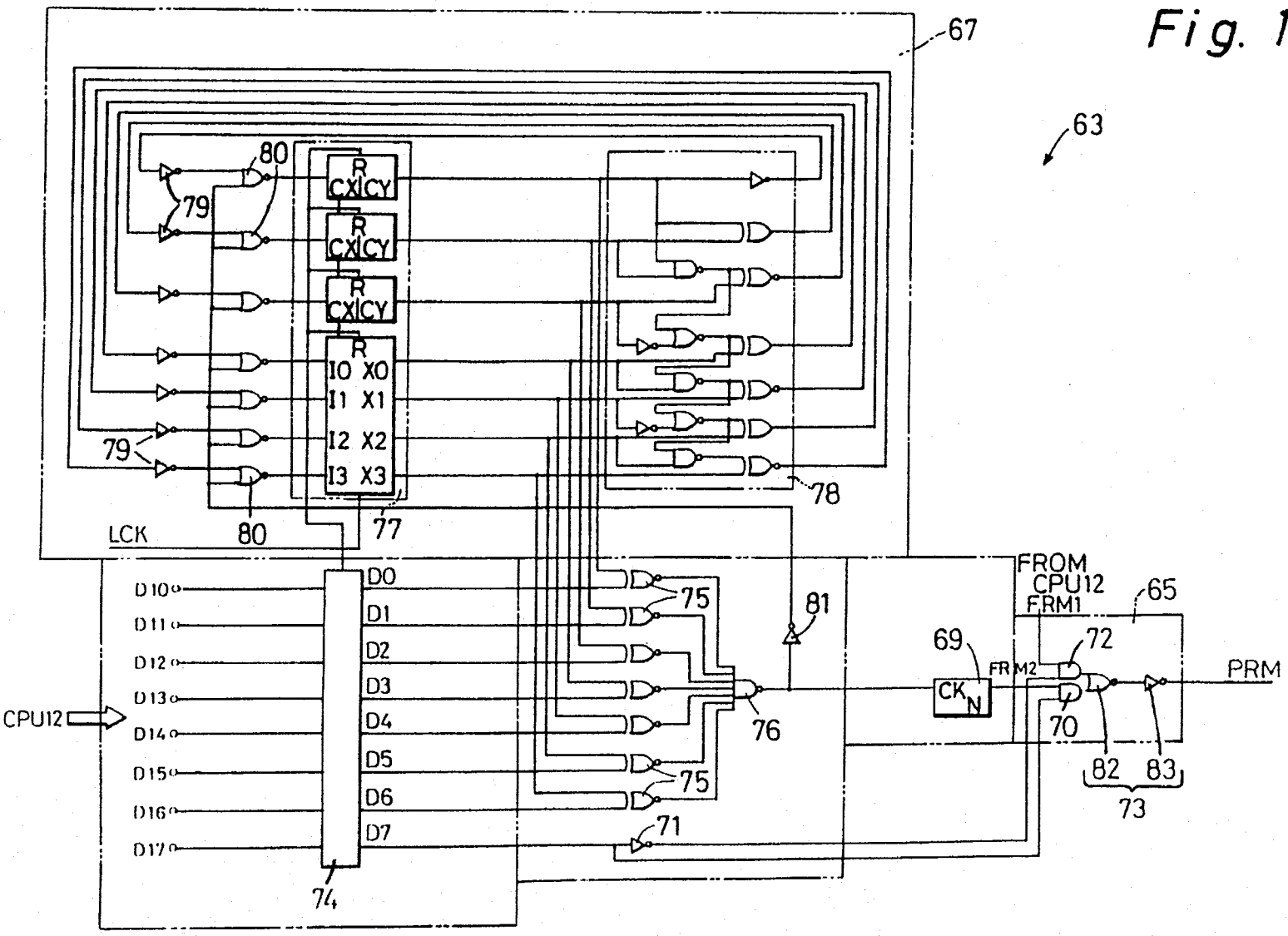
FIG. 14 is an exemplary circuit diagram of the signal generating circuit 63.

FIG. 14 is an exemplary circuit diagram of the signal generating circuit 63. The FRM register 64 and the memory unit 66 are respectively provided with a latch circuit 74 for storing 8-bit data from the CPU 12. Less significant bits D0 to D6 are inputted to six EXCLUSIVE OR circuits 75 included in the comparator circuit 68 individually respectively. The outputs of the respective EXCLUSIVE OR circuits 75 are inputted to a NAND circuit 76. An output of the NAND circuit 76 is inputted to the binary counter 69.

The counter circuit 67 is provided with a latch circuit 77 of 7 bits for latching the input data each time the clock signal LCK is inputted thereto. An output of the latch circuit 77 is inputted to an incrementing circuit 78. The incrementing circuit 78 increments the input data by one each time the output of the latch circuit 77 is inputted thereto, and outputs the same in the form of 7-bit parallel data. Each bit of the output of the incrementing circuit 78 is inputted to the corresponding bit of the latch circuit 77 through inversion circuits 79 and NOR circuits 80. Both the inversion circuits 79 and the NOR circuits 80 are provided for each bit. An output of the NAND circuit 76 is inverted in an inversion circuit 81, and the inverted output is inputted to the seven NOR circuits 80 as a reset signal for the counting circuit 67.

The 7-bit output of the latch circuit 77 is inputted to the seven EXCLUSIVE OR circuits 75 constituting the comparator circuit 68 for each bit. More specifically, when the parallel 7-bit output of the latch circuit 77 and the 7-bit output of the latch circuit 74 correspond with each other for each corresponding bit, 7-bit input to the NAND circuit 76 are all logic "1". Only in this case, the output of the NAND circuit 76 switches from the high level to the low level, which in turn counts up the binary counter 69. A signal indicative of that the NAND circuit 76 is switched from the high level to the low level fixes the respective outputs of the seven OR circuits 80 of the counting circuit 67 at low level, which in turn resets the latch circuit 77. The OR circuit 73 of the signal selection circuit 65 shown in FIG. 13 includes a NOR circuit 82 and an inversion circuit 83.

When a most significant bit D7 of the latch circuit 74 is set at "1", the AND circuit 70 is turned on while the AND circuit 72 is turned off. Accordingly, the OR circuit 73 outputs the second inversion signal FRM2 from the binary counter 69 as an inversion signal FRM. On the other hand, when the most significant bit D7 of the latch circuit 74 is set at "0", the AND circuit 72 is turned on while the AND circuit 70 is turned off. In this case, the OR circuit 73 outputs the first inversion signal FRM1 from the CPU 12 inputted to the AND circuit 72 as an inversion signal FRM from the signal selection circuit 65.

Figure 15:
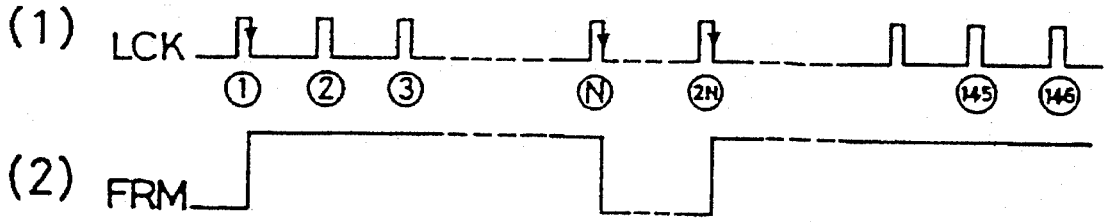
FIG. 15, (1) and (2) are respectively timing sequence diagrams of signals used in the embodiment.

FIGS. 15(1), 15(2) are respectively timing sequence diagrams of signals used showing an operation of the embodiment. There will be described a case where the FRM data N from the CPU 12 is preset in the seven less significant bits of the FRM register 64 shown in FIG. 13. After reset, the counting circuit 67 outputs a count value=1 to the comparator circuit 68 upon the fall of the first inputted clock signal LCK. The comparator circuit 68 in turn outputs the mismatch signal so as to cause the counting circuit 67 to continue its counting operation.

At this time, the output of the comparator circuit 68 is "1". In the case where the most significant bit FX of the FRM register 64 is "1", the high level output of the binary counter 69 is outputted as an inversion signal FRM of the signal selection circuit 65, thereby a Waveform represented by FIG. 15(2) can be obtained. Thereafter, when the count value of the counting circuit 67 reaches "N" the outputs of the seven EXCLUSIVE OR circuits 75 included in the comparator circuit 68 are all set at logic "1". Thereby, the output of the NAND circuit 76 is switched from the high level to the low level. At this timing, a non-inverted output of the binary counter 69 is switched to the low level. Consequently, the waveform represented by FIG. 15(2) can be obtained. Hereafter, by repeating the similar operation, the second inversion signal FRM2 from the binary counter 69 is outputted as an inversion signal FRM of the signal selection circuit 65.

Figure 3:
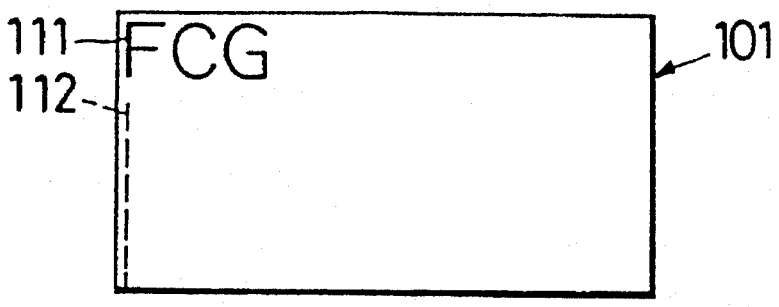
Fig. 3 Prior Art
FIG. 3 is a view showing an operation of the present embodiment and prior arts.
Figure 4:
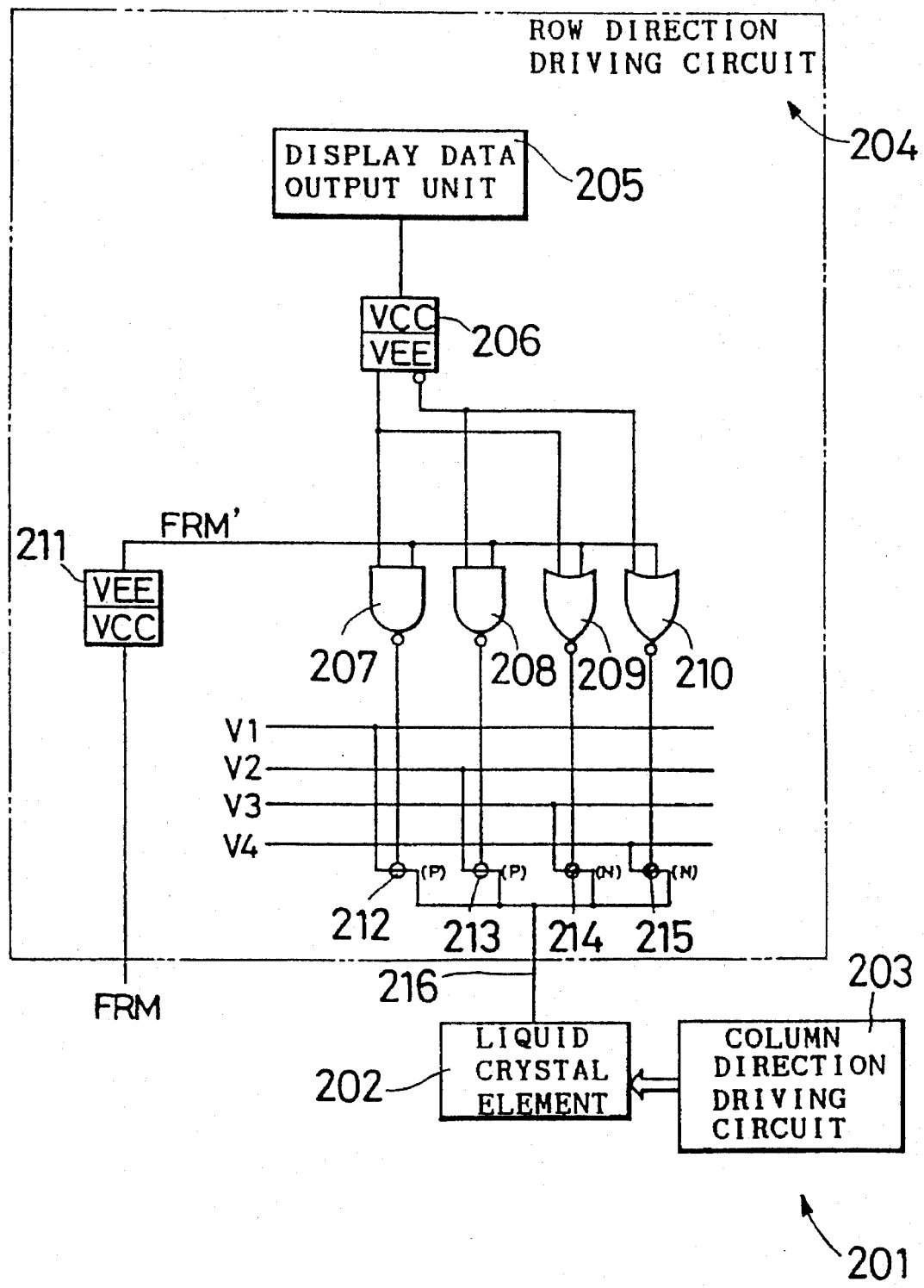
Fig. 4 Prior Art
FIG. 4 is a schematic circuit diagram of a liquid crystal display device 101 of a typical prior art.
Figure 5:
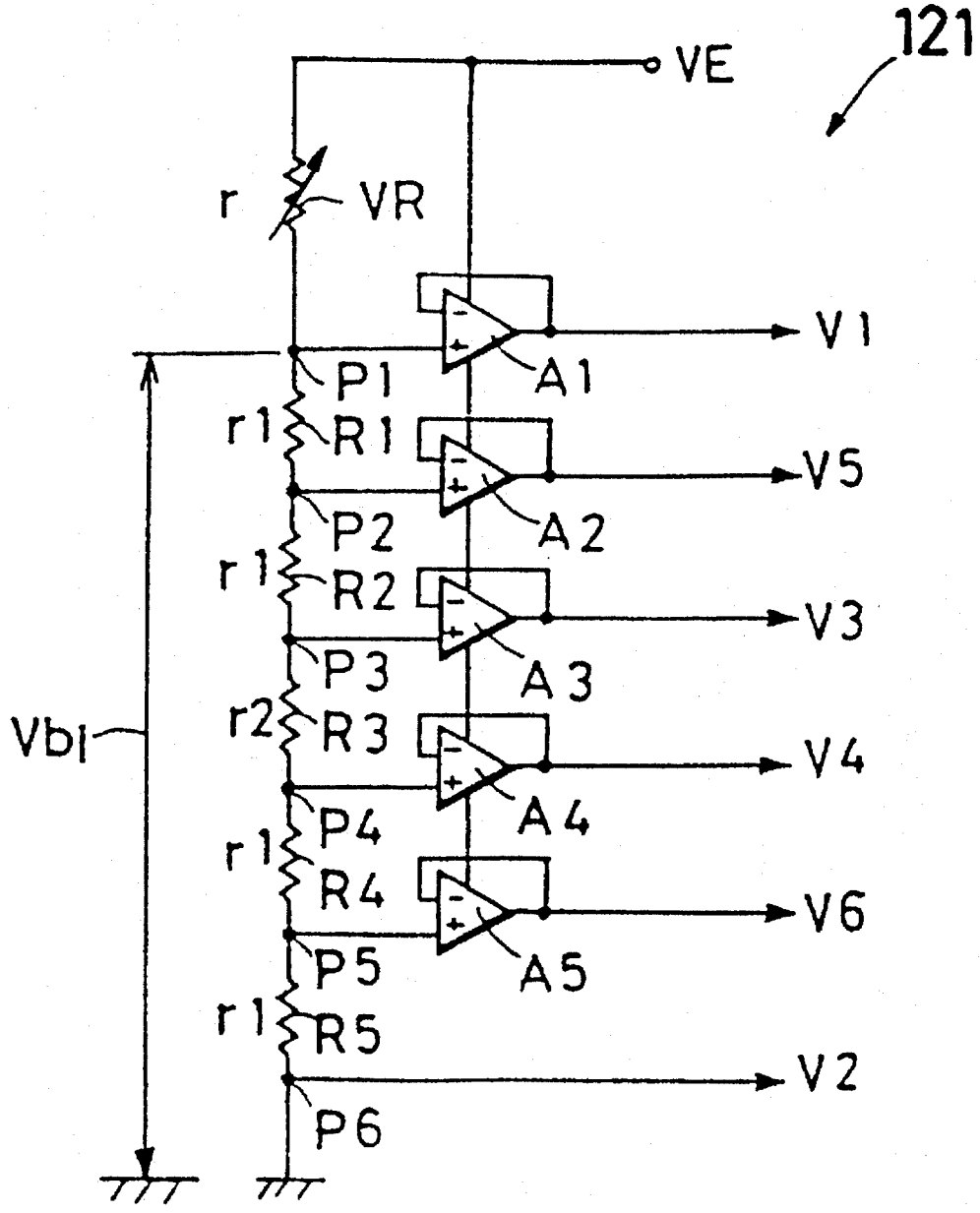
Fig. 5 Prior Art
FIG. 5 is a schematic circuit diagram of a display power circuit 121 of the typical prior art.
Figure 6A:
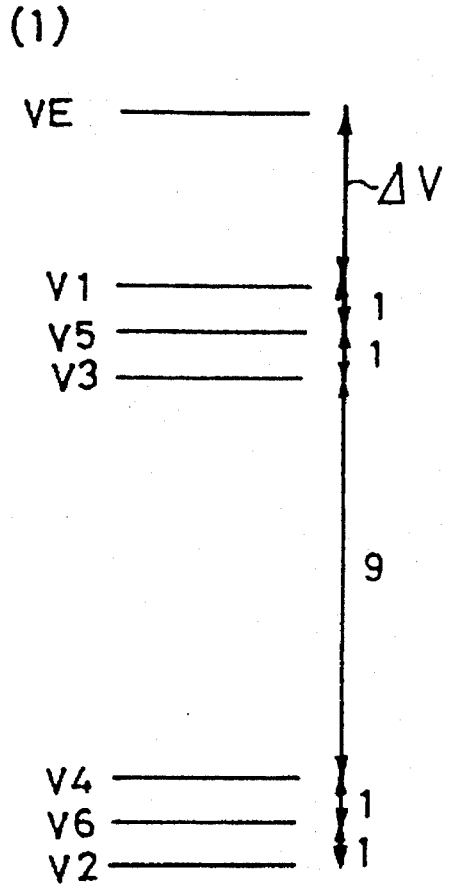
Fig. 6A Prior Art
FIGS. 6(A), 6(B) are diagrams respectively showing an operation of the prior art.
Figure 6B:
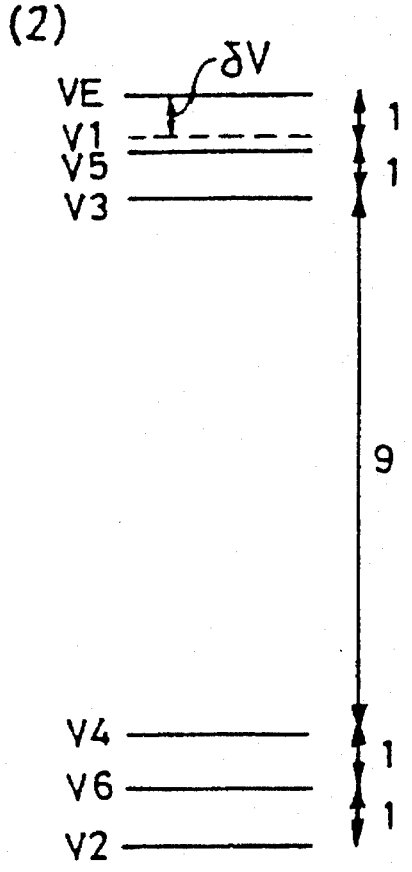
Fig. 6B Prior Art
Figure 7:
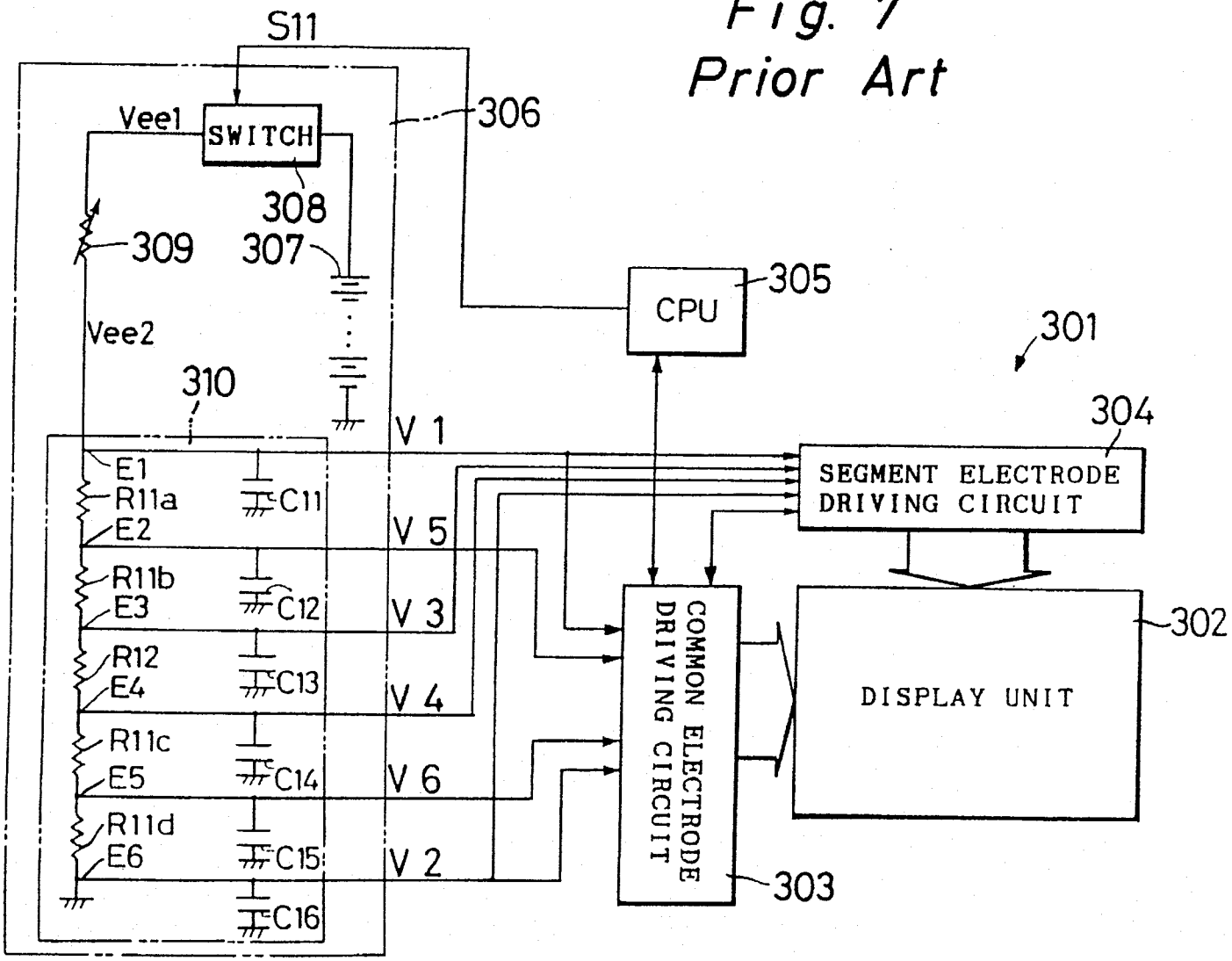
Fig. 7 Prior Art
FIG. 7 is a diagram showing a basic construction of a conventional liquid crystal display device 301.

The inversion signal FRM outputted from the signal selection circuit 65 has a frequency higher than that of the first inversion signal FRM1 sent from the CPU 12. Accordingly, the error display 112 can be prevented from occurring on the segment electrode having relatively many lighted addresses in the Y-direction as shown in the explanatory display of the liquid crystal display device 101 of the prior art with reference to FIG. 3.

On the other hand, as for the segment electrodes having relatively few lighted addresses in the display region of the liquid crystal display device 11, the most significant bit FX of the FRM register 64 is set at "0", whereby to use the first inversion signal FRM1 from the CPU 12. Accordingly, it is made possible to output the first inversion signal FRM1 from the signal generating circuit. 63 shown in FIG. 13. Consequently, for example, a more power saving data processing device 2 can be obtained.

Figure 16:
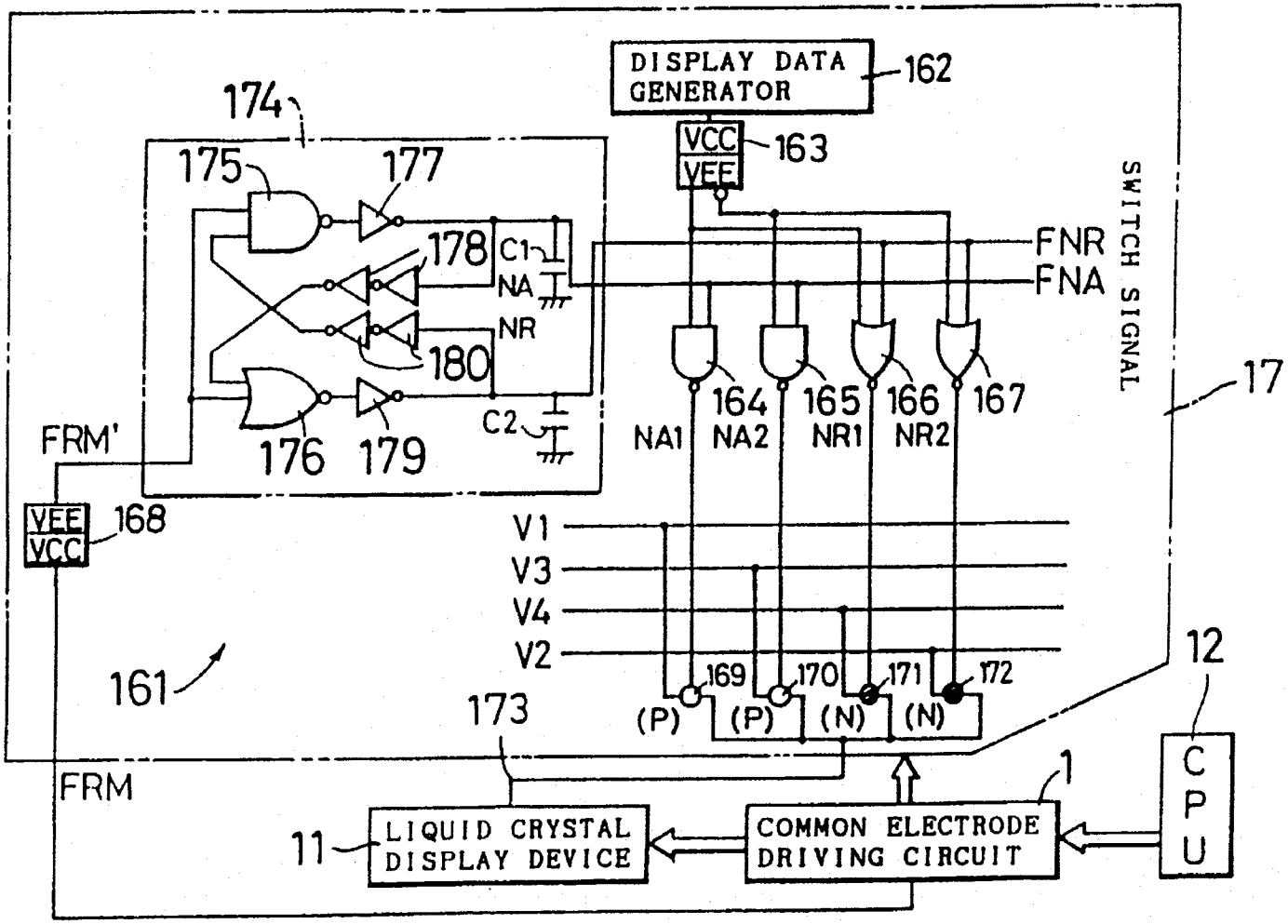
FIG. 16 is a block diagram showing a construction relating to a display voltage output circuit 161 of the embodiment.

FIG. 16 is a block diagram showing construction a display voltage output circuit 161 of the segment electrode driving circuit 17. The segment electrode driving circuit 17 is provided with a display data generator 162 having, for example, a random access memory (RAM). The display data to be outputted and the display addresses thereof in the liquid crystal display device 11 are fed from the common electrode driving circuit 1. In the case where the display data is to be written in the liquid crystal display 11, the write-in voltage based on the display data is alternated so that the polarity thereof is periodically inverted in accordance with the control signal, called as an inversion signal, in order to prevent a direct current (DC) from being applied to the liquid crystal. That is to say, the write-in voltage of reversed polarity is applied to the liquid crystal periodically alternately.

The display data outputted from the display data output unit 162 provided in the segment electrode driving circuit 17 has a voltage level thereof converted from, for example, a transistor level to a drive level of the liquid crystal display device 11 by a level shifter 163. An inverted output and a non-inverted output of the level shifter 163 are respectively inputted to pairs of the NAND circuits 164, 165 and the NOR circuits 166, 167.

To a display voltage unit unit 161 is sent the inversion signal FRM from the control circuit 19 provided in the common electrode driving circuit 1 so as to alternate the display voltage. The voltage level of the inversion signal FRM is amplified by a level shifter 168, which in turn outputs a voltage level amplified inversion signal FRM'. The inversion signal FRM' is inputted to the NAND circuits 164, 165, and the NOR circuits 166, 167 individually respectively.

On the other hand, in the display voltage output unit 161 are generated mutually different four kinds of drive potentials V1 to V4 to be applied to the liquid crystal display device 11. The respective potentials V1 to V4 are individually connected to switching circuits 169, 170, 171, and 172. Each of the switching circuits 169, 170 comprises a transistor having a P-channel MOS structure. Each of the switching circuits 171, 172 comprises a transistor having a N-channel MOS structure. The respective outputs of the switching circuits 169 to 172 are connected to a common line 173 to be inputted to the liquid crystal display device 11.

The inversion signal FRM' serving as an output of the level shifter 168 is inputted to a forced switching circuit 174. The forced switching circuit 174 comprises a NAND circuit 175 and a NOR circuit 176, to each of which the inversion signal FRM' is inputted. An output of the NAND circuit 175 is inputted to each of the NAND circuits 164, 165 through an inversion circuit 177, while being inputted to the NOR circuit 176 through a pair of inversion circuits 178. On the other hand, an output of the NOR circuit 176 is inputted to each of the NOR circuits 166, 167 through an inversion circuit 179 while being inputted to the NAND circuit 175 through a pair of inversion circuit 180. Capacitances C1, C2 provided respectively on the output sides of the inversion circuits 177, 179 are gate capacitances.

In the display voltage output unit 161 thus constructed, any one of the respective switching circuits 169 to 172 is turned on by the output of one of the circuits 164 to 167 corresponding thereto. The output of the circuits 164 to 167 are based on a combination of whether the waveform of the data from the level shifter 163 is high level or low level, and whether switch signals FNA, FNR from the forced switching circuit 174 to be described below are high level or low level. While one of the switching circuits 169 to 172 is turned on, the remaining three circuits are controllably turned off.

Figure 17:
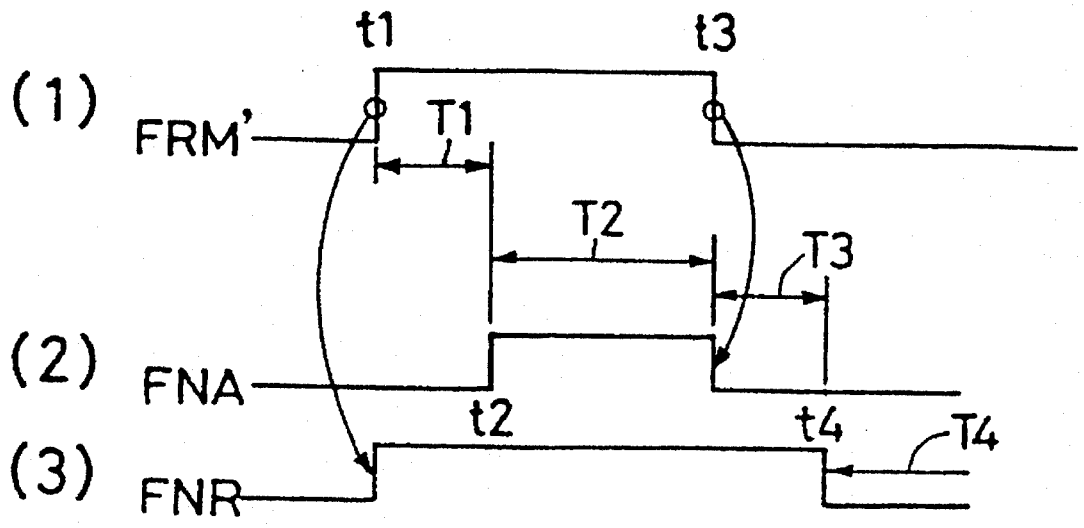
FIG. 17, (1), (2) and (3) are timing sequence diagrams of signals used in the embodiment.

FIGS. 17(1), 17(2), 17(3) are timing sequence diagrams of signals used in the embodiment showing an operation thereof. The inversion signal FRM' has the same phase as the inversion signal FRM, but voltage level thereof is higher than that of the inversion signal FRM. In this embodiment, the switch signals FNA, FNR are generated from the inversion signal FRM' by using the forced switching circuit 174. The switch signal FNA is inputted to each of the NAND circuits 164, 165. The switch signal FNR is inputted to each of the NOR circuits 166, 167.

The switch signal FNR is obtained through the NOR operation between the inversion signal FRM' and the switch signal FNA. Accordingly, the switch signal FNR rises to the high level at a timing t1 when the inversion signal FRM' rises to high level. On the other hand, the switch signal FNA is obtained through the AND operation between the inversion signal FRM' and the switch signal FNR. Accordingly, the switch signal FNA rises to the high level at a timing t2 delayed from the timing t1 by a time period T1 determined by the gate capacitance C2 under the influence thereof. The switch signals FNA, FNR are both in the high level state during a time period T2 defined by the timing t2 and a timing t3 when the inversion signal FRM' falls to the low level.

Upon the inversion signal FRM' falling to the low level at the timing t3, the switch signal FNA immediately falls to the low level since it is obtained through the AND operation between the inversion signal FRM' and the switch signal FNR. The switch signal FNR falls to the low level at a timing t4 delayed from the timing t3 by a time period T3 corresponding to the gate capacitance C1 since it is obtained through the NOR operation between the inversion signal FRM' and the switch signal FNA. During a time period T4 which starts at the timing t4, both the switch signals FNA, FNR are in the low level.

In this way, there are generated the switch signal FNA for controlling the P-channel switching circuits 169, 170 and the switch signal FNR for controlling the N-channel switching circuits 171,172.

States obtained based on the non-inverted data from the level shifter 163 and outputs NA1, NA2, NR1, NR2 respectively of the NAND circuits 164, 165 and the NOR circuits 166, 167 are shown in the following Tables 1 and 2 with respect to a case where the non-inverted output of the level shifter is "1" and another case where the non-inverted output of the level shifter 163 is "0". In the respective Tables 1 and 2, a symbol Z denotes a high impedance state.

TABLE 1

| | (Display Data = "1") | | | |
|---|---|---|---|---|
| Period | T1 | T2 | T3 | T4 |
| NA1 | 1 | (0) | 1 | 1 |
| NA2 | 1 | 1 | 1 | 1 |
| NR1 | 0 | 0 | 0 | 0 |
| NR2 | 0 | 0 | 0 | (1) |
| Level | Z | V1 | Z | V2 |

TABLE 2

| | (Display Date = "0") | | | |
|---|---|---|---|---|
| Period | T1 | T2 | T3 | T4 |
| NA1 | 1 | 1 | 1 | 1 |
| NA2 | 1 | (0) | 1 | 1 |
| NR1 | 0 | 0 | 0 | (1) |
| NR2 | 0 | 0 | 0 | 0 |
| Level | Z | V3 | Z | V4 |

(Mark "(1)", "(0)" represents a selecting)

During the time period T2, only the output NA1 is effective in the case where the display data=1, and thereby the drive potential V1 is selected. In the case where the display data=0, only the output NA2 is effective, and thereby the drive potential V3 is selected. Further, during the time period T4, only the output NR2 is effective in the case where the display data=1, and thereby the drive potential V2 is selected. In the case where the display data=0, only the output NR1 is effective, and thereby the drive potential V4 is selected.

During the time periods T1 and T3 which respectively start at the inverting timings t1, t3 of the inversion signal FRM' and lasts for predetermined period of time, any of the switching circuits 169 to 172 are turned off, whereby the common line 173 is induced to the high impedance state. Accordingly, the problem of an undesirable through current described with reference to the prior art can be prevented from occurring when the inversion signal FRM' switches from the high level to the low level, or vice-versa. Therefore, the segment electrode driving circuit 17 can be designed to consume less power. Further, by preventing the occurrence of the through current, electric problems liable to occur in the segment electrode circuit 17 can also be prevented.

Figure 18:
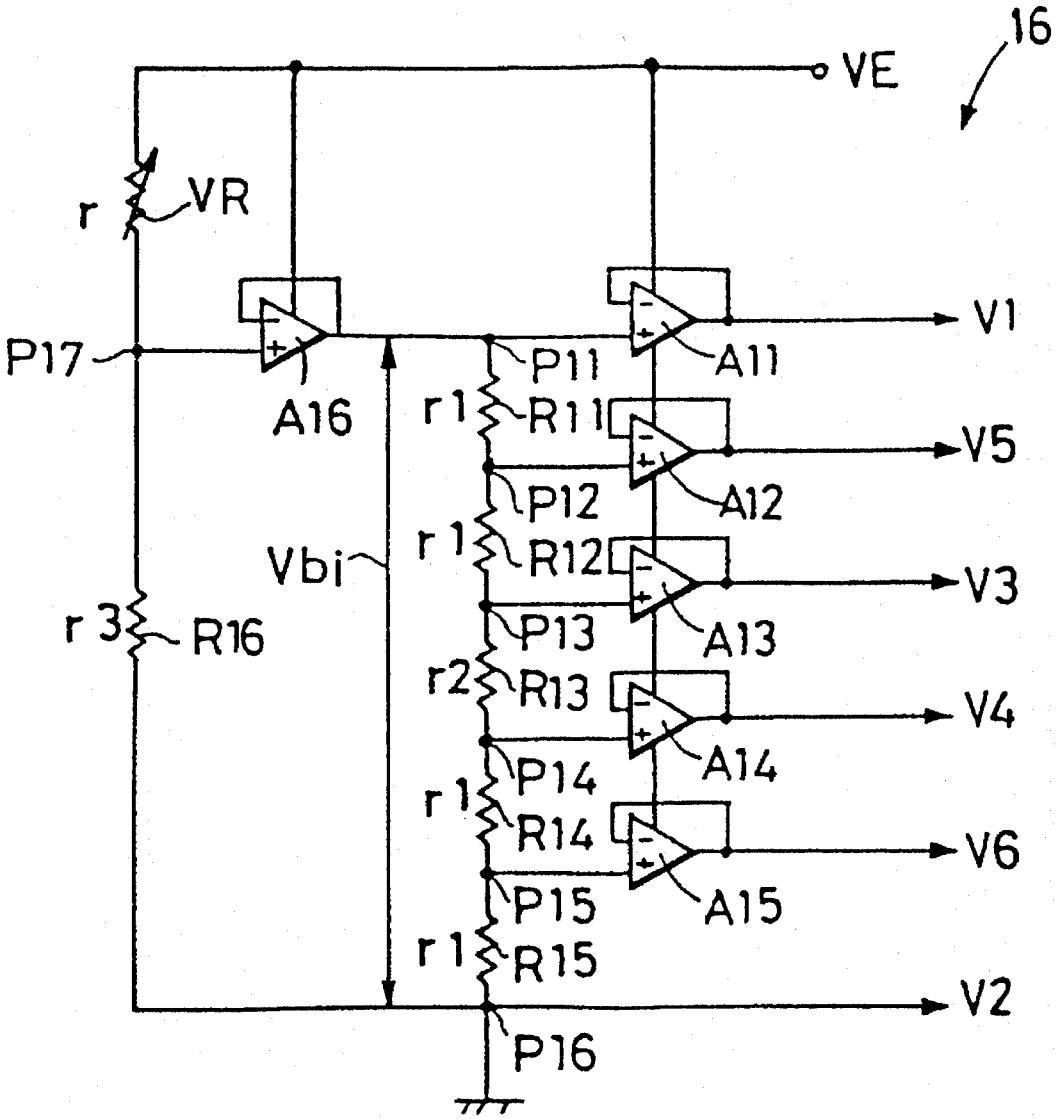
FIG. 18 is a block diagram showing a liquid crystal power circuit 16 of a driving device embodying the invention.

FIG. 18 is a circuit diagram showing an exemplary construction of the liquid crystal power circuit 16. The liquid crystal power circuit 16 comprises a variable resistor VR having a resistance value of r. One end of the variable resistor VR is connected to a display power potential VE. The other end of the variable resistor VR is grounded through a resistor R16 having a resistance value of r3. An amplifier A16 is connected to a node P17 between the variable resistor VR and the resistor R16, and an output thereof is connected to, for example, one end of a series circuit having five resistors R11 to R15. The other end of the series circuit is grounded. A node P11 connected to one end of the series circuit P11, and nodes P12 to P15 between the two adjoining resistors R12 to R15 are respectively connected to amplifiers A11 to A15.

Outputs of the respective amplifiers A11 to A15 and an output of a node P16 are respectively display voltages V1. V5, V3, V4, V6, and V2. Accordingly, a level relationship between the respective display voltages V1 to V6 and the display power voltage VE can be expressed in the following fifth equation (5).

$$VE \geqq V1 > V5 > V3 > V4 > V6 > V2 \quad (5)$$

The resistors R11 to R15 are bleeder resistors for dividing the voltage, and resistance values thereof are respectively set at r1, r1, r2, r1, and r1 similarly to the description made with reference to the prior art. An optimum bias voltage value Vbi between the resistance values r1, r2 and the resistors R11 to R15 can be obtained from the foregoing first equation (1) in the case where a duty of the common electrode driving circuit 1 of this embodiment is equal to 1/146 DUTY similar to the description made with reference to the prior art. Accordingly, the foregoing second and third equations (2), (3) are also satisfied, whereby the ratio of the display voltages is similar to the prior art, i.e., $$V1-V5:V5-V3:V3-V4:V4-V6:V6-V2 = 1:1:9:1:1$$

Figure 19A:
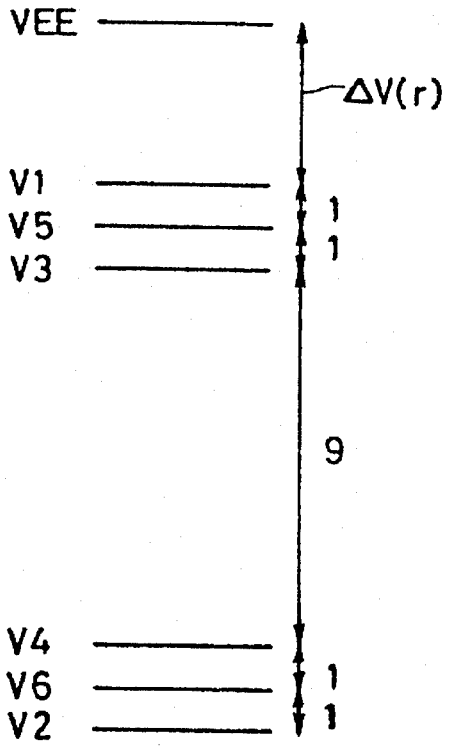
FIGS. 19(A), 19(B) are diagrams showing an operation of the embodiment.
Figure 19B:
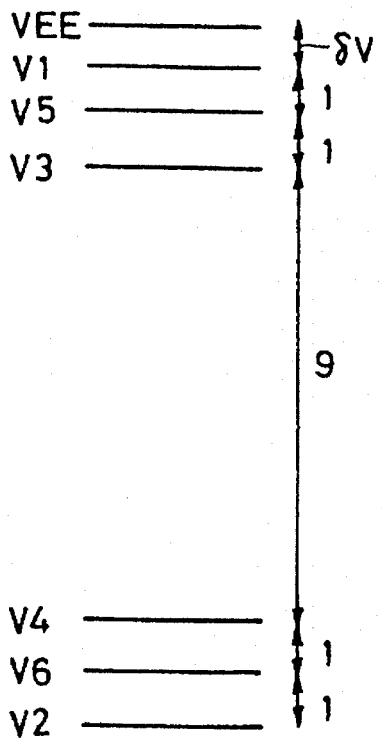

FIGS. 19(A), 19(B) are respectively diagram showing an operation of this embodiment. Upon a contrast adjustment being effected in the liquid crystal Vower circuit 16, the resistance value r of the variable resistor VR is set at a non-zero value. Thereby, the display power voltage VE is divided at a ratio of r:r3 which is the ratio of the resistance values between the variable resistor VR and the resistor R16, and has a current level thereof amplified by the amplifier A16. The voltage level outputted from the amplifier A16 is divided by the resistors R11 to R15. The divided voltages have the current levels thereof amplified by the respective amplifiers A11 to A15. Consequently, the display voltages V,1, V5, V3, V4, V6, V2 are outputted. This state is shown in FIG. 19(A). The maximum display voltage V1 is reduced from a reference display voltage VE only by ΔV(r).

In the case where the contrast adjustment is not to be effected in the liquid crystal power circuit 16, the resistance value r of the variable resistor VR is set at "0". Then, the voltage in the node P17 is equal to the reference display voltage VE. The voltage of this level is outputted through the amplifier A16 to be divided by the resistors R11 to R15. In the amplifier A16, the output voltage is in fact lower than the reference display voltage VE by a potential difference δV, e.g., about 2 to 3 V, according to the characteristics of the amplifier A16. However, the resistors R11 to R15 executes the voltage dividing with treating the output voltage as a reference display voltage.

Accordingly, it can be prevented that the level of only the display voltage V1 is reduced to an undesirable level, out of the display voltages V1, V5, V3, V4, V6 and V2 obtainable by amplifying the output voltages from the nodes P11 to P16 by the amplifiers A11 to A15. More specifically, as shown in FIG. 19(B), in the case where the resistance value r of the variable resistor VR is set at "0", when the maximum display voltage is reduced from the reference display voltage VE, the levels of the remaining display voltages V5, V3, V4, V6 and V2 are reduced by an amount corresponding to the ratio of the potential difference thereof.

As described above, in this embodiment, it can be prevented that the level of, for example, only the maximum display voltage V11 undesirably varies, out of the display voltages V1, V5, V3, V4, V6 and V2. Accordingly, such an occurrence can be prevented as to cause the quality of the display to be deteriorated, resulting from the fact that the foregoing ratio of the display voltages V1, V5, V4, V6 and V2 cannot be maintained because of the variation of the maximum display voltage V1.

Figure 20:
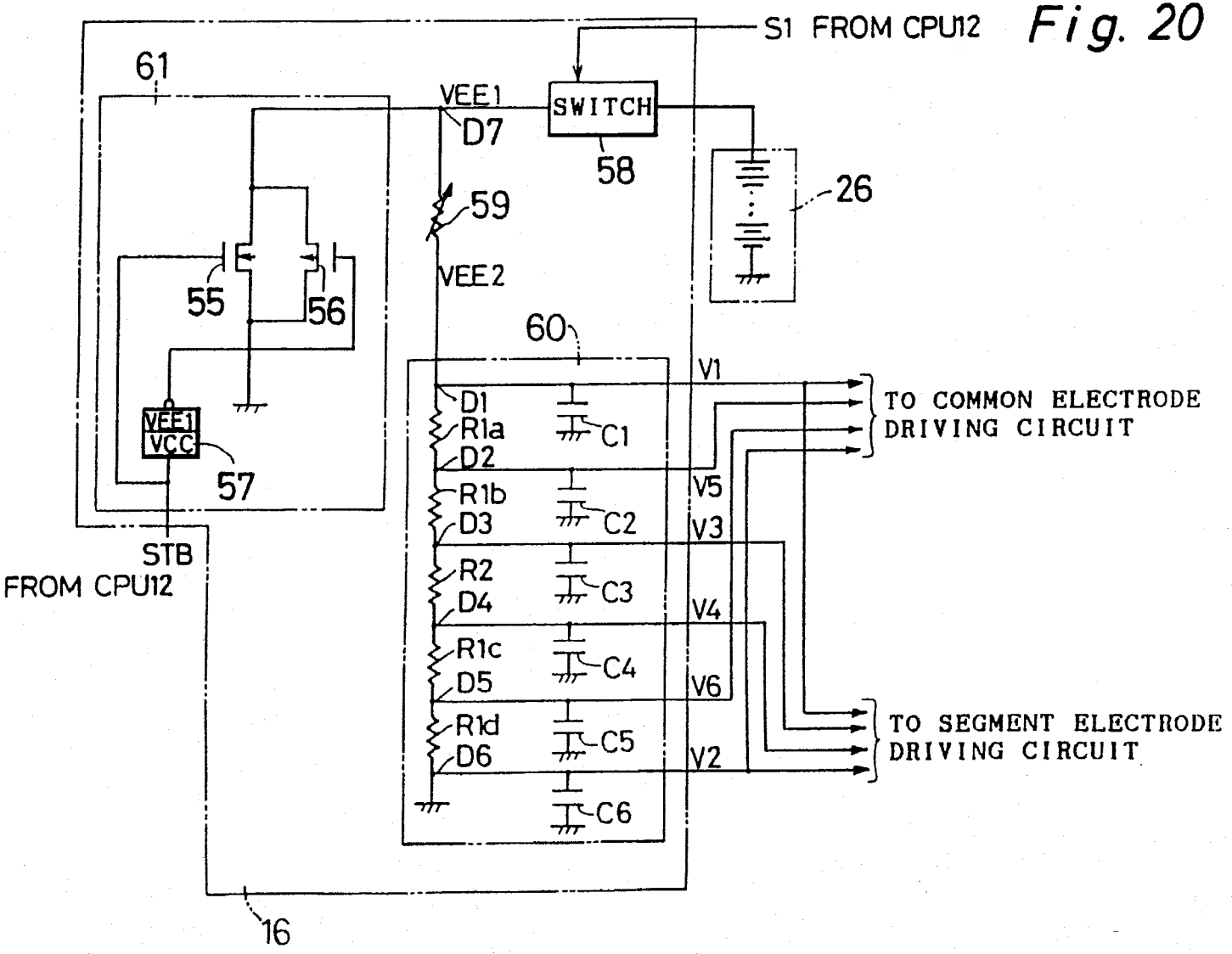
FIG. 20 is a circuit diagram showing a construction of the liquid crystal power circuit 16.

FIG. 20 is a circuit diagram showing a basic construction of the liquid crystal power circuit 16. The liquid crystal power circuit 16 feeds a liquid crystal drive voltage to the common electrode driving circuit 1 and the segment electrode driving circuit 17. In the liquid crystal power circuit 16, the voltage VEE1 from the power circuit 26 is adjusted by the variable resistor VR to a voltage VEE2 to be fed to an applied voltage generating circuit 60. A switch 58 is provided between the power circuit 26 and the variable resistor 59. The switch 58 is turned off in response to an OFF signal S1 fed from the CPU 12, whereby to interrupt the power supply from the power circuit 26 to the applied voltage generating circuit 60.

The applied voltage generating circuit 60 comprises five resistors R1*a*, R1*b*, R1*c*, R1*d* and R2 for dividing the voltage VEE2 to generate drive voltages V1 to V6. These five resistors R1*a*, R1*b*, R1*c*, R1*d* and R2 are generally referred to as bleeder resistors. The resistors R1*a*, R1*b*, R2, R1*c*, and R1*d* are connected in series to the variable resistor 59 in this order. One end of the resistor R1*d* is grounded. Resistance values r1a to r1d of the resistors R1*a* to R1*d* are set equal to each other. A resistance value r2 of the resistor R2 varies according to the drive duty DUTY of the liquid crystal display device 11 and the optimum bias voltage value B, and can be obtained using the following sixth equation (6).

$$B = (r1a \times 4 + r2)/r1a \quad (6)$$
$$= (\sqrt{DUTY}) + 1$$

Further, smoothing capacitors C1 to C6 are provided between nodes D1 to D6 and the common electrode driving circuit 1 or the segment electrode driving circuits 17 for stabilizing the supplied voltage.

Out of the voltages V1 to V6 from the liquid crystal power circuit 16, the voltages V1, V2, V5, V6 are supplied to the common electrode driving circuit 1, and the voltages V1, V2, V3, and V4 are supplied to the segment electrode driving circuit 17.

An electric charge discharging circuit 61 is connected to a node D7. The electric charge discharging circuit 61 comprises a N-channel type MOS 55 (hereinafter referred to as N-MOS), a P-channel type MOS 56 (hereinafter referred to as P-MOS), and a level shifter 57. To the node D7 is connected a drain side terminal of each of the N-MOS 55 and the P-MOS 56. Source side terminal of the N-MOS 55 and the P-MOS 56 are grounded. The N-MOS 55 operates on a normal logic type voltage Vcc (5 V type). Accordingly, a control signal STB from the CPU 12 is fed to a gate side terminal of the N-MOS 55. The potential VEE1 at the node D7 is variable in the range of 16 V to 30 V, and relatively high. Accordingly, the P-MOS 56 will not operate unless a signal having a high voltage is fed to a gate side terminal thereof. Therefore, to the gate side terminal of the P-MOS 56 is fed an output (voltage VEE1 type) from the level shifter 57.

Figure 21:
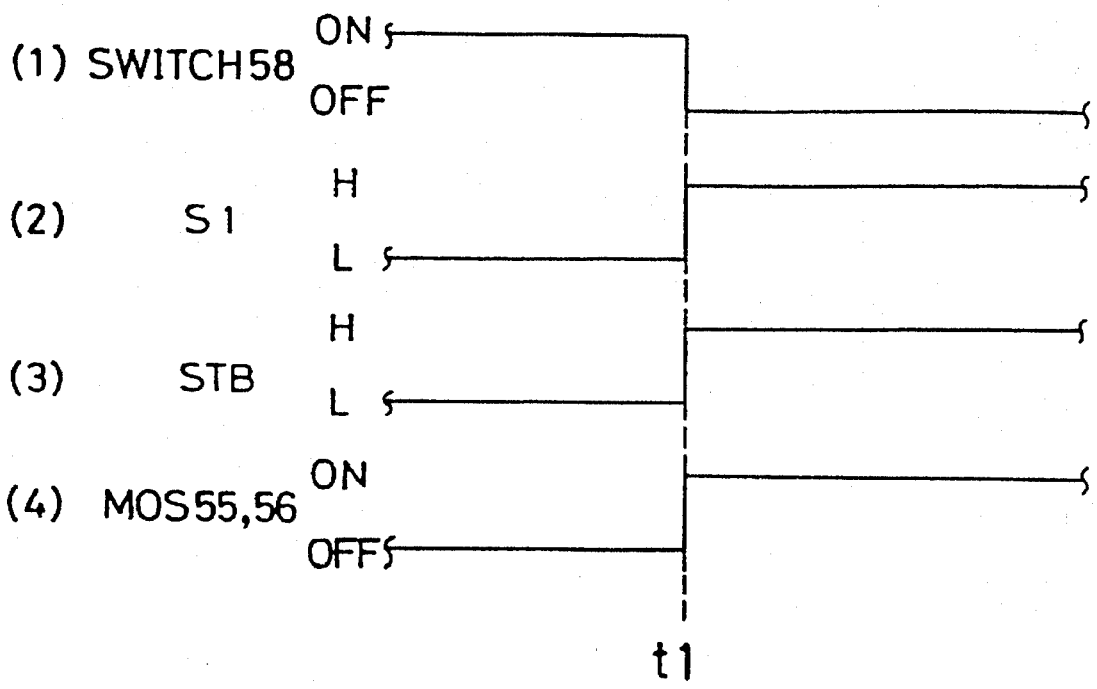
FIG. 21 is a timing charts showing the operation of the liquid crystal power circuit 16.

FIG. 21 is a timing chart showing the operation of the liquid crystal power circuit 16. In the case where an displayed image is to be cleared in the liquid crystal display device 11, the level of the OFF signal S1 is switched from the low level to the high level at a time t1 as shown in FIG. 21(2). Thereby, the switch 58 is turned off to interrupt the power supply from the power circuit 26 to the applied voltage generating circuit 60 (see FIG. 21(1)). Thereafter, the level of the control signal STB is immediately switched to the high level (see FIG. 21(3)), whereby the N-MOS 55 and the P-MOS 56 are turned on simultaneously (see FIG. 21(4)). Accordingly, the node D7 is grounded, and thereby the potential VEE1 becomes "0", causing the electric charges stored in the capacitors C1 to C6 to be forcibly discharged. As a result, the electric charges stored in the capacitors C1 to C6 will not be supplied to the liquid crystal display device 11. Therefore, the likelihood can be prevented that a residual image is displayed on the screen after the displayed image is cleared.

As described above, according to the foregoing embodiment, by providing the electric charge discharging circuit 61, the charges stored in the capacitors C1 to C6 can be forcibly discharged after the displayed image is cleared, preventing the residual image from being displayed on the screen. Consequently, the quality of the display in the liquid crystal display device 11 can be improved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. Apparatus for driving an LCD electrode matrix, the driving apparatus comprising:

a controller which outputs a display signal for application to the LCD matrix and which outputs an output inversion signal to switch periodically polarity of the display signal, wherein the controller programmably selects between a nominal duration inversion signal and a programmable duration inversion signal as the output inversion signal, the nominal duration inversion signal and the programmable duration inversion signal being of mutually different frequencies, the controller comprising a plurality of settable bits, with one settable bit serving as a signal select bit for programmable selection between the nominal duration inversion signal and the programmable duration inversion signal and others of the settable bits being used to store a value indicative of a cycle of the programmable duration inversion signal;

a cycle determination circuit for using clock pulses input thereto and the value indicative of the programmable duration inversion signal to generate the programmable duration inversion signal; and a signal selection circuit responsive to the signal select bit for selecting between the nominal duration inversion signal and the programmable duration inversion signal;

wherein the signal selection circuit comprises:

an inverter having an input terminal connected to receive the signal select bit;

a first AND gate, the first AND gate having a first input terminal and a second input terminal, the first input terminal of the first AND gate being connected to receive the signal select bit, the second input terminal of the first AND gate being connected to receive the programmable duration inversion signal;

a second AND gate, the second AND gate having a first input terminal and a second input terminal, the first input terminal of the second AND gate being connected to receive the nominal duration inversion signal, the second input terminal of the second AND gate being connected to an output terminal of the inverter; and an OR gate, the OR gate having a first input terminal and a second input terminal, the first input terminal of the OR gate being connected to an output terminal of the first AND gate, the second input terminal of the OR gate being connected to an output terminal of the second AND gate, the output inversion signal being outputted at an output terminal of the OR gate.

2. The apparatus of claim 1, wherein the programmable duration inversion signal has a frequency higher than the nominal duration inversion signal.

3. Apparatus for driving an LCD electrode matrix, the driving apparatus comprising:

a controller which outputs a display signal for application to the LCD matrix and which outputs an output inversion signal to switch periodically polarity of the display signal, wherein the controller programmably selects between a nominal duration inversion signal and a programmable duration inversion signal as the output inversion signal, the nominal duration inversion signal and the programmable duration inversion signal being of mutually different frequencies, the controller comprising a plurality of settable bits, with one settable bit serving as a signal select bit for programmable selection between the nominal duration inversion signal and the programmable duration inversion signal and others of the settable bits being used to store a value indicative of a cycle of the programmable duration inversion signal;

a cycle determination circuit for using clock pulses input thereto and the value indicative of the programmable duration inversion signal to generate the programmable duration inversion signal; comprising:

a first counter for counting the clock pulses;

a comparator circuit connected to compare the clock pulses counted by the first counter with the value indicative of the programmable inversion signal and for generating a comparison signal, which comparison signal resets the first counter when the clock pulses counted by the first counter equals the value indicative of the programmable inversion signal; and a signal selection circuit responsive to the signal select bit for selecting between the nominal duration inversion signal and the programmable duration inversion signal.

4. Apparatus for driving an LCD electrode matrix, the driving apparatus being of a type which generates a display signal for application to a plurality of switching circuits, each switching circuit being connected to also receive a unique voltage potential, output terminals of each of the switching circuits being connected to a common line whereby a selected one of the plurality of switching circuits applies its received unique voltage potential to the common line, the common line in turn being connected to the LCD electrode matrix; and wherein the driving apparatus comprises a forced switching circuit which receives an inversion signal to switch periodically polarity of the display signal, the forced switching circuit controlling the plurality of gates so that non-selected ones of the plurality of switching circuits are turned off for a predetermined period upon a switch of polarity of the inversion signal, and wherein a signal applied on the common line is turned off during the predetermined period;

wherein the forced switching circuit comprises:

a NAND gate having a first input terminal connected to receive the inversion signal;

a first inverter connected to an output terminal of the NAND gate;

a first capacitor connected to an output terminal of the first inverter;

a serially connected first pair of inverters connected to an output terminal of the first inverter;

a NOR gate having a first input terminal connected to receive the inversion signal and a second input terminal connected to an output terminal of the first pair of inverters;

a second inverter connected to an output terminal of the NOR gate;

a second capacitor connected to an output terminal of the second inverter;

a serially connected second pair of inverters connected to an output terminal of the second inverter, an output terminal of the second pair of inverters being connected to a second input terminal of the NAND gate.

5. The apparatus of claim 4, whereby the forcing switching circuit controls the plurality of gates so the plurality of switching circuits do not output their unique voltages in time overlapping manner.

6. The apparatus of claim 4, wherein the signal on the common line is set at a high impedance during the predetermined period.

7. Apparatus for driving an LCD electrode matrix, the driving apparatus comprising:

a generator for generating a display signal;

a plurality of gates, each gate of the plurality of gates connected to receive one of the display signal or an inverted display signals;

a plurality of switching circuits, each switching circuit being connected to an output terminal of a corresponding one of the plurality of gates and to a unique voltage potential, output terminals of each of the switching circuits being connected to a common line whereby a selected one of the plurality of switching circuits applies its received unique voltage potential to the common line, the common line in turn being connected to the LCD electrode matrix;

a forced switching circuit which receives an inversion signal to switch periodically polarity of the display signal, the forced switching circuit controlling the plurality of gates so that non-selected ones of the plurality of switching circuits are turned off for a predetermined period upon a switch of polarity of the inversion signal, and wherein a signal applied on the common line is turned off during the predetermined period;

wherein the forced switching circuit comprises:

a NAND gate having a first input terminal connected to receive the inversion signal;

a first inverter connected to an output terminal of the NAND gate;

a first capacitor connected to an output terminal of the first inverter;

a serially connected first pair of inverters connected to an output terminal of the first inverter;

a NOR gate having a first input terminal connected to receive the inversion signal and a second input terminal connected to an output terminal of the first pair of inverters;

a second inverter connected to an output terminal of the NOR gate;

a second capacitor connected to an output terminal of the second inverter;

a serially connected second pair of inverters connected to an output terminal of the second inverter, and output terminal of the second pair of inverters being connected to a second input terminal of the NAND gate.

8. The apparatus of claim 7, wherein the output terminal of the first inverter is connected to a first and a second of the gates in the plurality of gates, and wherein the output terminal of the second inverter is connected to a third and a fourth of the gates in the plurality of gates, and wherein the first and third of the gates receive the display signal and the second and fourth of the gates receive the inverted display signal.

9. Apparatus for driving an LCD electrode matrix, the driving apparatus comprising:

a generator for generating a display signal;

a plurality of gates, each gate of the plurality of gates connected to receive one of the display signal or an inverted display signal;

a plurality of switching circuits, each switching circuit being connected to an output terminal of a corresponding one of the plurality of gates and to a unique voltage potential, output terminals of each of the switching circuits being connected to a common line whereby a selected one of the plurality of switching circuits applies its received unique voltage potential to the common line, the common line in turn being connected to the LCD electrode matrix;

a forced switching circuit which receives an inversion signal to switch periodically polarity of the display signal, the forced switching circuit controlling the plurality of gates so that non-selected ones of the plurality of switching circuits are turned off for a predetermined period upon a switch of polarity of the inversion signal, and wherein a signal applied on the common line is turned off during the predetermined period;

whereby the forcing switching circuit controls the plurality of gates so the plurality of switching circuits do not output their unique voltages in time overlapping manner.

10. The apparatus of claim 9, wherein the signal on the common line is set at a high impedance during the predetermined period.

* * * * *